US012258966B2

(12) United States Patent
Park et al.

(10) Patent No.: US 12,258,966 B2
(45) Date of Patent: Mar. 25, 2025

(54) ROTARY COMPRESSOR WITH VANE SUPPORT PORTION TO SUPPRESS OR PREVENT AXIAL VANE TILTING

(71) Applicant: LG ELECTRONICS INC., Seoul (KR)

(72) Inventors: Joonhong Park, Seoul (KR); Seoungmin Kang, Seoul (KR); Jinung Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/443,400

(22) Filed: Feb. 16, 2024

(65) Prior Publication Data

US 2024/0309870 A1 Sep. 19, 2024

(30) Foreign Application Priority Data

Mar. 16, 2023 (KR) ..... 10-2023-0034742

(51) Int. Cl.
*F04C 18/344* (2006.01)
*F01C 21/08* (2006.01)
(Continued)

(52) U.S. Cl.
CPC ..... *F04C 18/344* (2013.01); *F01C 21/0854* (2013.01); *F01C 21/108* (2013.01);
(Continued)

(58) Field of Classification Search
CPC ..... F04C 18/344; F04C 29/02; F04C 29/12; F04C 2240/50; F04C 2270/12;
(Continued)

(56) References Cited

U.S. PATENT DOCUMENTS

2015/0132168 A1 5/2015 Tsuda et al.
2017/0350391 A1* 12/2017 Tsuda ..... F04C 18/344
(Continued)

FOREIGN PATENT DOCUMENTS

CN 104929932 A * 9/2015 ..... F01C 21/0863
CN 218266336 1/2023
(Continued)

OTHER PUBLICATIONS

European Search Report issued in Application No. 24161977.4 dated Aug. 2, 2024.

*Primary Examiner* — Mary A Davis
(74) *Attorney, Agent, or Firm* — KED & ASSOCIATES

(57) ABSTRACT

A rotary compressor is disclosed. The rotary compressor may include a casing, a cylinder, main and sub bearings, a rotational shaft, a roller, at least one vane, and a vane support portion that axially supports the at least one vane formed on a bearing surface to extend along a reciprocating direction of the at least one vane from an inner circumferential surface of at least one back pressure pocket at an end of circumferential ends of the at least one back pressure pocket, adjacent to a contact point, and/or protrude axially from the inner circumferential surface of the at least one back pressure pocket and extend in a circumferential direction. This may secure a wide axial support area for a rear end of the at least one vane passing the contact point and/or near the contact point, to suppress or prevent axial tilting of the at least one vane, thereby reducing friction loss, wear, and vibration noise due to the axial tilting of the at least one vane during operation of the compressor.

9 Claims, 18 Drawing Sheets

(51) Int. Cl.
*F01C 21/10* (2006.01)
*F04C 29/02* (2006.01)
*F04C 29/12* (2006.01)

(52) U.S. Cl.
CPC ..... *F04C 29/02* (2013.01); *F04C 29/12* (2013.01); *F04C 2240/50* (2013.01); *F04C 2270/12* (2013.01); *F04C 2270/13* (2013.01); *F04C 2270/16* (2013.01)

(58) Field of Classification Search
CPC ..... F04C 2270/13; F04C 2270/16; F01C 21/0854; F01C 21/108
See application file for complete search history.

(56) References Cited

U.S. PATENT DOCUMENTS

| | | | | |
|---|---|---|---|---|
| 2021/0363990 | A1 | 11/2021 | Shin et al. | |
| 2021/0363991 | A1* | 11/2021 | Park ..... | F04C 18/344 |
| 2022/0228587 | A1 | 7/2022 | Lee et al. | |

FOREIGN PATENT DOCUMENTS

| | | |
|---|---|---|
| JP | 2013-213438 | 10/2013 |
| JP | 2020-070780 | 5/2020 |
| KR | 10-2020-0057542 | 5/2020 |
| KR | 10-2022-0131075 | 9/2022 |
| WO | WO 2014/203879 | 12/2014 |

* cited by examiner

ROTARY COMPRESSOR WITH VANE SUPPORT PORTION TO SUPPRESS OR PREVENT AXIAL VANE TILTING

CROSS-REFERENCE TO RELATED APPLICATION(S)

Pursuant to 35 U.S.C. § 119(a), this application claims the benefit of the earlier filing date and the right of priority to Korean Patent Application No. 10-2023-0034742, filed in Korea on Mar. 16, 2023, the contents of which are incorporated by reference herein in their entirety.

BACKGROUND

1. Field

A concentric rotary compressor is disclosed herein.

2. Background

Rotary compressors may be classified into two types, namely, a type in which a vane is slidably inserted into a cylinder to be in contact with a roller, and another type in which a vane is slidably inserted into a roller to be in contact with a cylinder. In general, the former is called a roller eccentric rotary compressor (hereinafter, referred to as a "rotary compressor"), and the latter is referred to as a vane concentric rotary compressor (hereinafter, referred to as a "concentric rotary compressor").

As for a rotary compressor, a vane inserted in a cylinder is pulled out toward a roller by elastic force or back pressure to come into contact with an outer circumferential surface of the roller. The rotary compressor independently forms compression chambers as many as the number of vanes per revolution of the roller, and the compression chambers simultaneously perform suction, compression, and discharge strokes.

On the other hand, as for a concentric rotary compressor, a vane inserted in a roller rotates together with the roller, and is pulled out by centrifugal force and back pressure to come into contact with an inner circumferential surface of a cylinder. The concentric rotary compressor continuously forms as many compression chambers as the number of vanes per revolution of the roller, and the compression chambers sequentially perform suction, compression, and discharge strokes. Accordingly, the concentric rotary compressor has a higher compression ratio than the rotary compressor. Therefore, the concentric rotary compressor is more suitable for high pressure refrigerants, such as R32, R410a, and $CO_2$, which have low ozone depletion potential (ODP) and global warming index (GWP).

The related art vane rotary compressor discloses a structure in which a plurality of vanes is slidably inserted into a rotating roller. In other words, in the related art vane rotary compressor, a back pressure chamber is formed at a rear end portion of the vane, to communicate with a back pressure pocket. The back pressure pocket is divided into a first pocket forming an intermediate pressure and a second pocket forming a discharge pressure or an intermediate pressure close to the discharge pressure. The first pocket communicates with a back pressure chamber located at an upstream side and the second pocket communicates with a back pressure chamber located at a downstream side, with respect to a direction from a suction side to a discharge side.

However, in the related art concentric rotary compressor as described above, both axial side surfaces of the vane overlap the back pressure pocket during operation, thereby reducing an axial support area of the vane. In particular, the vane is subject to a strong gas force near a contact point, so if both the axial side surfaces of the vane are not sufficiently supported, the vane may tilt in the axial direction. As a result, wear may occur not only on both of the axial side surfaces of the vane but also on an axial bearing surface of a main bearing and an axial bearing surface of a sub bearing facing the side surfaces, or wear may occur even on a front end surface of the vane and an inner circumferential surface of the cylinder facing the end surface. This may cause an increase in vibration noise in a specific area and leakage between compression chambers, thereby lowering compression efficiency.

Those problems become more serious when a high-pressure refrigerant, such as R32, R410a, or $CO_2$ is used. When the high-pressure refrigerant is used, a same level of cooling capability may be obtained as that obtained when using a relatively low-pressure refrigerant, such as R134a, even though a volume of each compression chamber is reduced by increasing the number of vanes. However, as the number of vanes increases, a friction area between the vanes and the cylinder increases accordingly. As a result, a bearing surface on a first vale support al shaft is reduced, which makes a behavior of the rotational shaft more unstable, ending up with a further increase in mechanical friction loss. This problem may be escalated under a heating and low-temperature condition, a high-pressure ratio condition ($Pd/Ps \geq 6$), and a high-speed driving condition (80 Hz or more).

BRIEF DESCRIPTION OF THE DRAWINGS

Embodiments will be described in detail with reference to the following drawings in which like reference numerals refer to like elements, and wherein.

DETAILED DESCRIPTION

Description will now be given of a concentric rotary compressor according to embodiments disclosed herein, with reference to the accompanying drawings. For reference, an oil supply hole according to embodiments may be equally applied to a concentric rotary compressor in which a vane is slidably inserted into the roller.

For example, the embodiments may be applied not only to an example in which the vane slot is inclined but also to an example in which the vane slot is formed radially. Hereinafter, an example in which a vane slot is inclined relative to a roller and an inner circumferential surface of a cylinder has an asymmetric elliptical shape will be described as a representative example.

In addition, the embodiments may be equally applied to a horizontal type in which a casing is parallel to an installation surface as well as a vertical type in which the casing is perpendicular to the installation surface as illustrated in an embodiment disclosed herein. Hereinafter, a vertical type compressor will be explained as a representative example.

Figure 1:
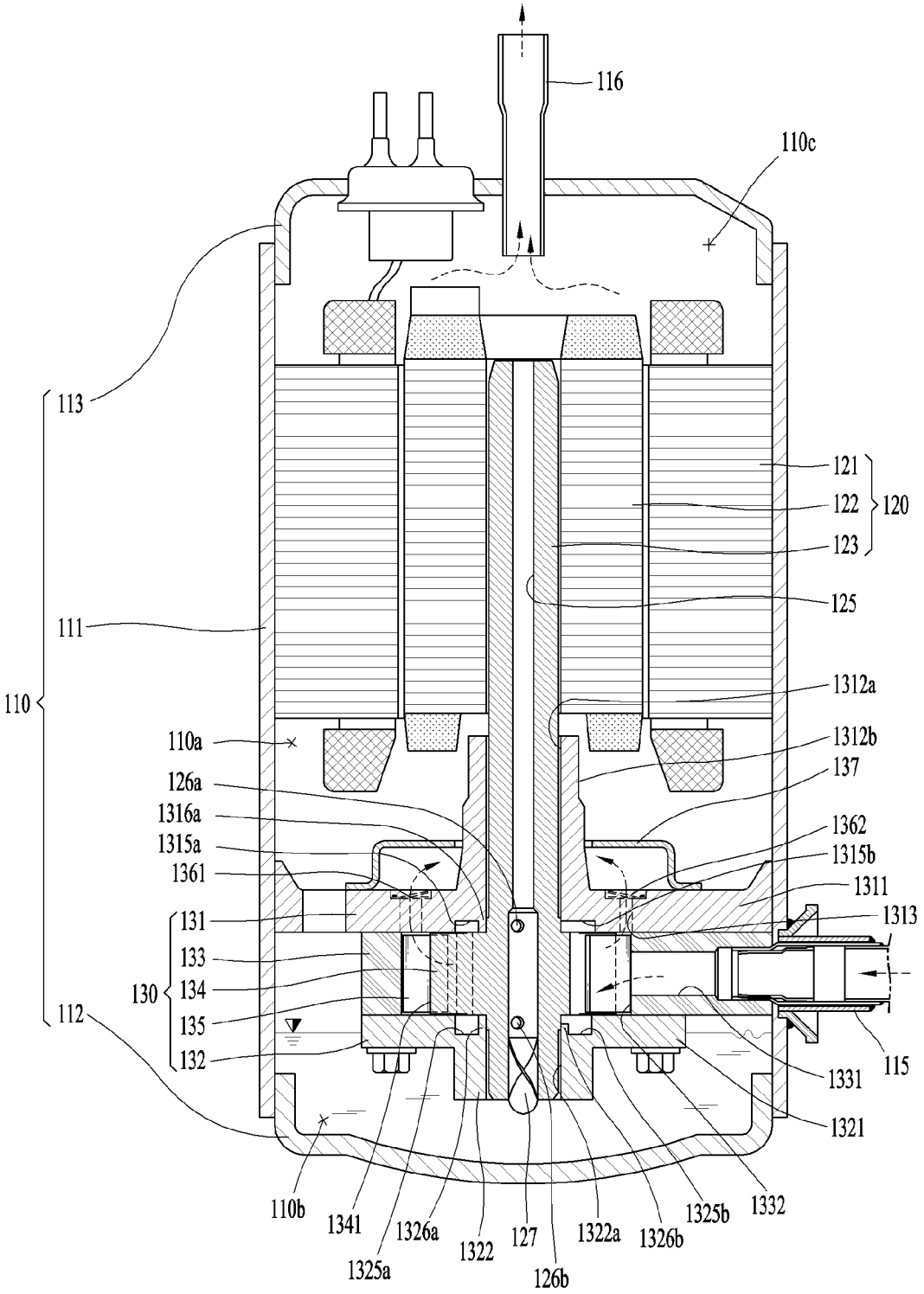
FIG. 1 is a cross-sectional view of a concentric rotary compressor according to an embodiment.
Figure 2:
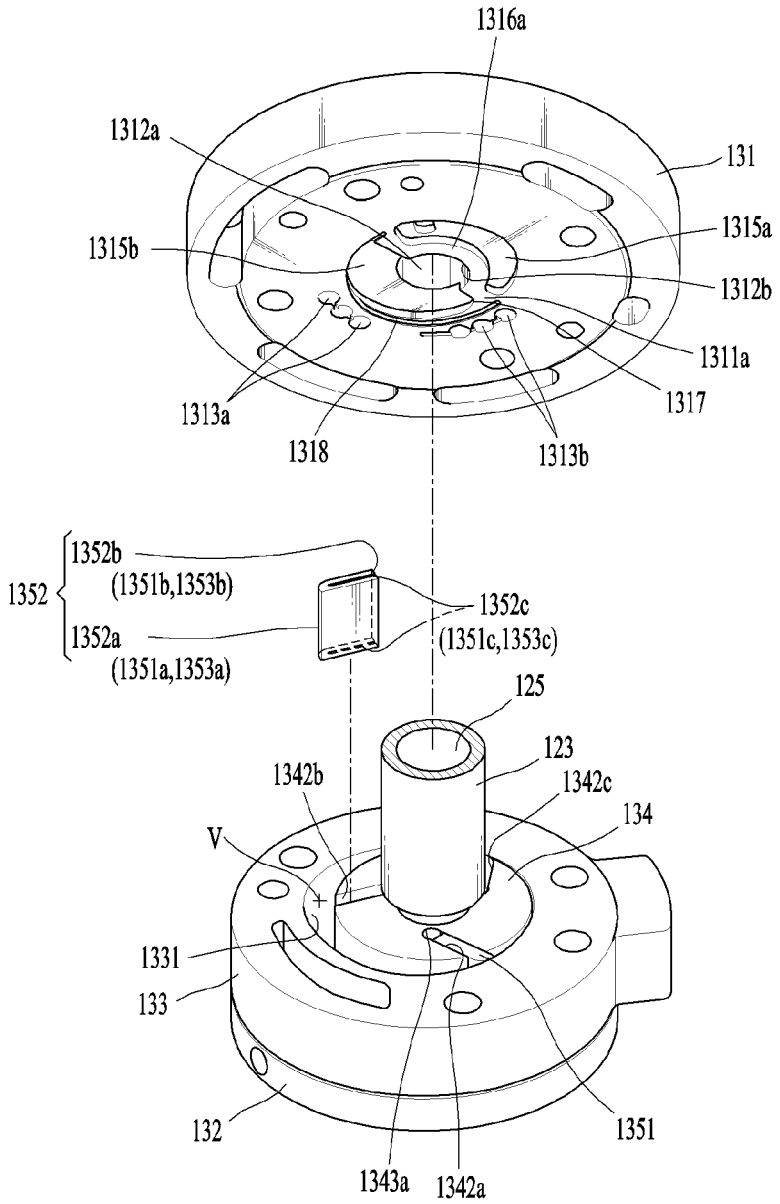
FIG. 2 is an exploded perspective view of a compression unit of the rotary compressor of FIG. 1.
Figure 3:
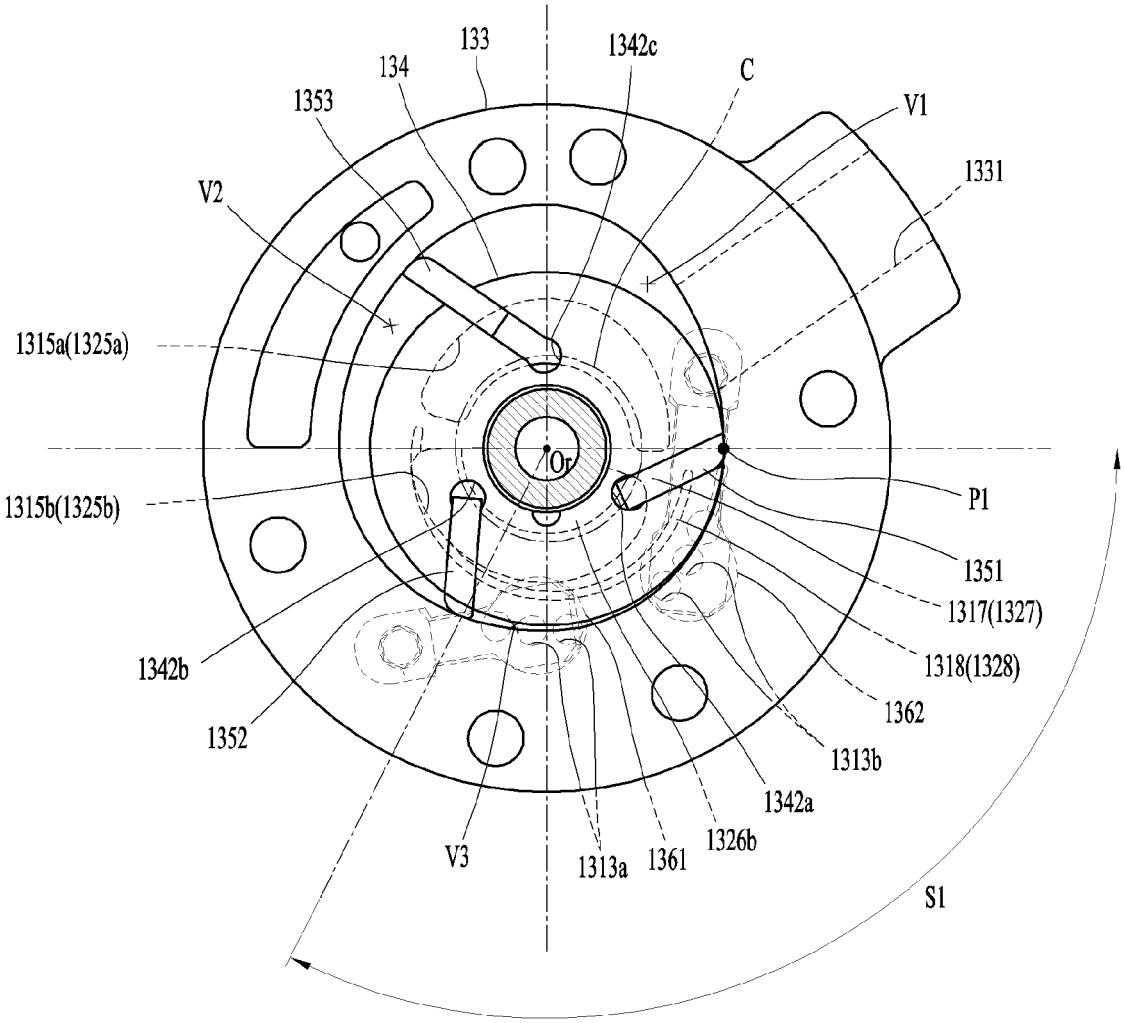
FIG. 3 is a planar view of an assembled state of the compression unit in FIG. 2.

FIG. 1 is a cross-sectional view of a concentric rotary compressor according to an embodiment. FIG. 2 is an exploded perspective view of a compression unit of the rotary compressor in FIG. 1, and FIG. 3 is an assembled planar view of the compression unit in FIG. 2.

Referring to FIG. 1, a concentric rotary compressor according to an embodiment may include a casing 110, a drive motor 120, and a compression unit 130. The drive motor 120 may be installed in an upper inner space 110*a* of the casing 110, and the compression unit 130 may be installed in a lower inner space 110*a* of the casing 110. The drive motor 120 and the compression unit 130 may be connected through a rotational shaft 123.

The casing 110 defines an appearance of the compressor and may include an intermediate shell 111 having a cylindrical shape, a lower shell 112 that covers a lower end of the intermediate shell 111, and an upper shell 113 that covers an upper end of the intermediate shell 111. The drive motor 120 and the compression unit 130 may be inserted into the intermediate shell 111 to be fixed thereto, and a suction pipe 115 may penetrate through the intermediate shell 111 to be directly connected to the compression unit 130. The lower shell 112 may be coupled to the lower end of the intermediate shell 111 in a sealing manner, and an oil storage space 110*b* in which oil to be supplied to the compression unit 130 is stored may be formed below the compression unit 130. The upper shell 113 may be coupled to the upper end of the intermediate shell 111 in a sealing manner, and an oil separation space 110*c* may be formed above the drive motor 120 to separate oil from refrigerant discharged from the compression unit 130.

The drive motor 120 that constitutes a motor unit supplies power to cause the compression unit 130 to be driven. The drive motor 120 may include a stator 121, a rotor 122, and the rotational shaft 123.

The stator 121 may be fixedly inserted into the casing 110. The stator 121 may be fixed to an inner circumferential surface of the casing 110 in, for example, a shrink-fitting manner. For example, the stator 121 may be press-fitted into an inner circumferential surface of the intermediate shell 111.

The rotor 122 may be rotatably inserted into the stator 121, and the rotational shaft 123 may be press-fitted into a center of the rotor 122. Accordingly, the rotational shaft 123 may rotate concentrically together with the rotor 122.

An oil flow path 125 having a hollow hole shape may be formed in a central portion of the rotational shaft 123, and oil passage holes 126*a* and 126*b* may be formed through a middle portion of the oil flow path 125 toward an outer circumferential surface of the rotational shaft 123. The oil passage holes 126*a* and 126*b* may include first oil passage hole 126*a* belonging to a range of a main bush portion 1312 described hereinafter and a second oil passage hole 126*b* belonging to a range of a second bearing portion 1322. Each of the first oil passage hole 126*a* and the second oil passage hole 126*b* may be provided as one or a plurality. In this embodiment, each of the first and second oil passage holes is provided as a plurality.

An oil pickup 127 may be installed at a middle or lower end of the oil passage 125. A gear pump, a viscous pump, or a centrifugal pump may be used for the oil pickup 127, for example. This embodiment illustrates a case in which the centrifugal pump is employed. Accordingly, when the rotational shaft 123 rotates, oil filled in the oil storage space 110*b* is pumped by the oil pickup 127 and is suctioned along the oil flow path 125, so as to be introduced to a sub bearing surface 1322*b* of the sub bush portion 1322 through the second oil passage hole 126*b* and to a main bearing surface 1312*b* of the main bush portion 1312 through the first oil passage hole 126*a*.

The compression unit 130 may include a main bearing 131, a sub bearing 132, a cylinder 133, a roller 134, and a plurality of vanes 1351, 1352, and 1353. The main bearing 131 and the sub bearing 132 may be respectively provided at upper and lower portions of the cylinder 133 to define a compression space V together with the cylinder 133, the roller 134 may be rotatably installed in the compression space V, and the plurality of vanes 1351, 1352, and 1353 may be slidably inserted into the roller 134 to divide the compression space V into a plurality of compression chambers.

Referring to FIGS. 1 to 3, the main bearing 131 may be fixedly installed in the intermediate shell 111 of the casing 110. For example, the main bearing 131 may be inserted into the intermediate shell 111 and, for example, welded thereto.

The main bearing 131 may be coupled to an upper end of the cylinder 133 in a close contact manner. Accordingly, the main bearing 131 may define an upper surface of the compression space V, and support an upper surface of the roller 134 in an axial direction while supporting an upper-half portion of the rotational shaft 123 in a radial direction.

The main bearing 131 may include a main plate portion 1311 and a main bush portion 1312. The main plate portion 1311 may cover an upper portion of the cylinder 133 to be coupled thereto, and the main bush portion 1312 may axially extend from a center of the main plate portion 1311 toward the drive motor 120 so as to support the upper portion of the rotational shaft 123.

The main plate portion 1311 may have a disk shape, and an outer circumferential surface of the main plate portion 1311 may be fixed to the inner circumferential surface of the intermediate shell 111 in a close contact manner. One or more discharge ports 1313*a*, 1313*b* may be formed in the main plate portion 1311. A plurality of discharge valves 1361, 1362 configured to open and close the respective discharge ports 1313*a*, 1313*b* may be installed on an upper surface of the main plate portion 1311. A discharge muffler 137 having a discharge space (no reference numeral) may be provided at an upper portion of the main plate portion 1311 to accommodate the discharge ports 1313*a*, 1313*b* and the discharge valves 1361, 1362.

A first main back pressure pocket 1315*a* and a second main back pressure pocket 1315*b* may be formed in a bearing surface (hereinafter, a main axial bearing surface) 1311*a* of the main plate portion 1311 facing an upper surface of the roller 134, of both axial side surfaces of the main plate portion 1311. The first main back pressure pocket 1315*a* and the second main back pressure pocket 1315*b*, each having an arcuate shape, may be disposed at a predetermined interval in a circumferential direction. Each of the first main back pressure pocket 1315*a* and the second main back pressure pocket 1315*b* may have an inner circumferential surface with a circular shape, but may have an outer circumferential surface with an oval or elliptical shape in consideration of vane slots described hereinafter.

The first main back pressure pocket 1315*a* and the second main back pressure pocket 1315*b* may be formed within an outer diameter range of the roller 134. Accordingly, the first main back pressure pocket 1315*a* and the second main back pressure pocket 1315*b* may be separated from the compression space V. However, the first main back pressure pocket 1315*a* and the second main back pressure pocket 1315*b* may slightly communicate with each other through a gap between a lower surface, a main axial bearing surface 1311*a* of the main plate portion 1311 and the upper surface of the roller 134 facing each other unless a separate sealing member is provided therebetween.

The first main back pressure pocket 1315*a* forms a pressure lower than a pressure formed in the second main back pressure pocket 1315*b*, for example, forms an intermediate pressure between a suction pressure and a discharge pressure. Oil (refrigerant oil) may pass through a fine passage between a first main bearing protrusion 1316*a* described hereinafter and the upper surface 134*a* of the roller 134 so as to be introduced into the first main back pressure pocket 1315*a*. The first main back pressure pocket 1315*a* may be formed in the range of a compression chamber forming the intermediate pressure in the compression space V. This may allow the first main back pressure pocket 1315*a* to maintain the intermediate pressure.

The second main back pressure pocket 1315*b* may form a pressure higher than that in the first main back pressure pocket 1315*a*, for example, a discharge pressure or an intermediate pressure between a suction pressure close to the discharge pressure and the discharge pressure. Oil flowing into the main bearing hole 1312*a* of the main bearing 1312 through the first oil passage hole 126*a* may be introduced into the second main back pressure pocket 1315*b*. The second main back pressure pocket 1315*b* may be formed in the range of a compression chamber forming a discharge pressure in the compression space V. This may allow the second main back pressure pocket 1315*b* to maintain the discharge pressure. A first main bearing protrusion 1316*a* may be formed on an inner circumferential side of the first main back pressure pocket 1315*a* to extend from a main radial bearing surface 1312*b* of the main bush portion 1312. Accordingly, the first main back pressure pocket 1315*a* may be sealed from outside and simultaneously the rotational shaft 123 may be stably supported.

An inner circumferential side of the second main back pressure pocket 1315*b* may be open without a separate bearing protrusion. Accordingly, the inner circumferential side of the second main back pressure pocket 1315*b* may be completely open toward the oil passage 125, so that oil passing through the oil passage 125 may quickly flow into the second main back pressure pocket 1315*b*, causing a fast increase in back pressure toward the vane 1351, 1352, 1353.

Although not illustrated, a second main bearing protrusion 1316*b* may be formed on the inner circumferential side of the second main back pressure pocket 1315*b* to extend from the main radial bearing surface 1312*b* of the main bush portion 1312. In this case, the rotational shaft 123 may be supported more stably by the first main bearing protrusion 1316*a* and the second main bearing protrusion 1316*b*.

Referring to FIGS. 2 and 3, a vane support portion (hereinafter, main vane support protrusion) 1317 that supports an axial upper surface of the vane 1351, 1352, 1353 may be formed on one or a first end of the second main back pressure pocket 1315*b*. For example, the main vane support protrusion 1317 may extend in a reciprocating direction of the vane 1351, 1352, 1353 from one or a first end, facing the contact point P1 in the circumferential direction, of both circumferential ends of the second main back pressure pocket 1315*b*. Accordingly, an axial upper surface of the vane 1351, 1352, 1353 at a rear end, passing the contact point P1 and/or near the contact point P1, may be supported in the axial direction by the main vane support protrusion 1317.

The main vane support protrusion 1317 may be formed such that an inner circumferential surface of the first side of the second main back pressure pocket 1315*b* extends toward an inner circumferential surface of another or a second side of the second main back pressure pocket 1315*b* facing the first side. For example, the main vane support protrusion 1317 may be formed inside of the second main back pressure pocket 1315*b* and extend from the main axial bearing surface 1311*a* facing the upper surface of the roller 134. In other words, the main vane support protrusion 1317 may extend from the inner circumferential surface of the second main back pressure pocket 1315*b*, to be located at a same height as the main axial bearing surface 1311*a* of the main plate portion 1311. Accordingly, a portion of the second main back pressure pocket 1315*b* may form the main axial bearing surface 1311*a*, to expand a support area for an axial upper surface of the vane 1351, 1352, 1353. With this structure, the main vane support protrusion 1317 may effectively suppress or prevent axial tilting of the vane 1351, 1352, 1353 that passes the contact point P1 and/or near the contact point P1. The main vane support protrusion 1327 will be described hereinafter together with a sub vane support protrusion 1327 described hereinafter.

In addition, an oil supply groove (hereinafter, referred to as main oil supply groove) 1318 may be formed in the main axial bearing surface 1311*a* of the main plate portion 1311, and at least a portion of the main oil supply groove 1318 may radially overlap the main vane support protrusion 1317. For example, one or a first end of the main oil supply groove 1318 may communicate with the second main back pressure pocket 1315*b*, and another or a second end of the main oil supply groove 1318 may extend to surround a radial outside of the second main back pressure pocket 1315*b*. In this case, the second end of the main oil supply groove 1318 may extend in the circumferential direction to be closer to the contact point P1 than the second main back pressure pocket 1315*b*. Accordingly, a portion of the main oil supply groove 1318 may overlap the main vane support protrusion 1317 in the radial direction, to provide lubrication between a bearing surface of the main vane support protrusion 1317 and the axial upper surface of the vane 1351, 1352, 1353 facing the bearing surface.

The main bush portion 1312 may be formed in a hollow bush shape, and a first oil groove 1312*c* may be formed in an inner circumferential surface of the main bearing hole 1312*a* that defines an inner circumferential surface of the main bush portion 1312. The first oil groove 1312*c* may be formed in a straight or inclined shape, for example, between upper and lower ends of the main bush portion 1312 to communicate with the first oil passage hole 126*a*.

Referring to FIGS. 1 to 3, the sub bearing 132 may be coupled to a lower end of the cylinder 133 in a close contact manner. Accordingly, the sub bearing 132 may define a lower surface of the compression space V, and support a lower surface of the roller 134 in the axial direction while supporting a lower-half portion of the rotational shaft 123 in the radial direction.

The sub bearing 132 may include a sub plate portion 1321 and the sub bush portion 1322. The sub plate portion 1321 may cover a lower portion of the cylinder 133 to be coupled to thereto, and the sub bush portion 1322 may axially extend from a center of the sub plate portion 1321 toward the lower shell 112 so as to support the lower portion of the rotational shaft 123. The sub plate portion 1321 may have a disk shape like the main plate portion 1311, and an outer circumferential surface of the sub plate portion 1321 may be spaced apart from the inner circumferential surface of the intermediate shell 111.

A first sub back pressure pocket 1325*a* and a second sub back pressure pocket 1325*b* may be formed on a bearing surface (hereinafter, referred to as sub axial bearing surface) 1321*a* of the sub plate portion 1321, which faces the lower surface of the roller 134, of both axial side surfaces of the sub plate portion 1321. The first sub back pressure pocket 1325*a* and the second sub back pressure pocket 1325*b* may be symmetrical to the first main back pressure pocket 1315*a* and the second main back pressure pocket 1315*b*, respectively, with respect to the roller 134. For example, the first sub back pressure pocket 1325*a* and the first main back pressure pocket 1315*a* may be symmetrical to each other, and the second sub back pressure pocket 1325*b* and the second main back pressure pocket 1315*b* may be symmetrical to each other.

A first sub bearing protrusion 1326*a* may be formed on an inner circumferential side of the first sub back pressure pocket 1325*a*, and a second sub bearing protrusion 1326*b* may be formed on an inner circumferential side of the second sub back pressure pocket 1325*b*. The first sub bearing protrusion 1326*a* and the second sub bearing protrusion 1326*b* may have a same height or different heights.

For example, when the first sub bearing protrusion 1326*a* and the second sub bearing protrusion 1326*b* have the same height, an oil communication groove (not illustrated) or an oil communication hole (not illustrated) may be formed on an end surface of the sub main bearing protrusion 1316*b* such that inner and outer circumferential surfaces of the second sub bearing protrusion 1326*b* may communicate with each other. Accordingly, high-pressure oil (refrigerant oil) flowing into the sub radial bearing surface (no reference numeral) may be introduced into the second sub back pressure pocket 1325*b* through the oil communication groove (not illustrated) or the oil communication hole (not illustrated).

On the other hand, when the first sub bearing protrusion 1326*a* and the second sub bearing protrusion 1326*b* have different heights, the height of the second sub bearing protrusion 1326*b* may be lower than the height of the first sub bearing protrusion 1326*a*. Accordingly, high-pressure oil (refrigerant oil) flowing into the sub bearing hole 1322*a* may be introduced into the second sub back pressure pocket 1325*b* by flowing over the second sub bearing protrusion 1326*b*.

A description of the first sub back pressure pocket 1325*a*, the second sub back pressure pocket 1325*b*, and the first sub bearing protrusion 1326*a* may be replaced with the description of the first main back pressure pocket 1315*b*, the second main back pressure pocket 1315*b*, and the first main bearing protrusion 1316*a*. However, the second sub bearing protrusion 1326*b* may alternatively be formed stepwise on the inner circumferential side of the second sub back pressure pocket 1325*b*. In this case, a radial support area of the rotational shaft 123 may be expanded to effectively suppress or prevent tilting of the rotational shaft 123 and simultaneously to suppress or prevent foreign substances mixed with oil from flowing through the second sub back pressure pocket 1325*b*.

The first sub back pressure pocket 1325*a* and the second sub back pressure pocket 1325*b* may be asymmetrical to the first main back pressure pocket 1315*a* and the second main back pressure pocket 1315*b*, respectively, with respect to the roller 134. For example, the first sub back pressure pocket 1325*a* and the second sub back pressure pocket 1325*b* may be formed to be deeper than the first main back pressure pocket 1315*a* and the second main back pressure pocket 1315*b*, respectively.

Referring to FIGS. 1 and 3, a vane support portion (hereinafter, sub vane support protrusion) 1327 that supports the axial upper surface of the vane 1351, 1352, 1353 may be formed on one or a first end of the second sub back pressure pocket 1325*b*. For example, the sub vane support protrusion 1327 may extend in a reciprocating direction of the vane 1351, 1352, 1353 from the first end facing the contact point P1 in the circumferential direction, of both circumferential ends of the second sub back pressure pocket 1325*b*. Accordingly, the axial upper surface of the vane 1351, 1352, 1353 at the rear end, passing the contact point P1 and/or near the contact point P1, may be supported in the axial direction by the sub vane support protrusion 1327.

The sub vane support protrusion 1327 may be formed such that an inner circumferential surface of one or a first side of the second sub back pressure pocket 1325*b* extends toward an inner circumferential surface of another or a second side of the second sub back pressure pocket 1325*b* facing the first side. For example, the sub vane support protrusion 1327 may be formed inside of the second sub back pressure pocket 1325*b* and extend from the sub axial bearing surface 1321*a* facing a lower surface of the roller 134. In other words, the sub vane support protrusion 1327 may extend from the inner circumferential surface of the second sub back pressure pocket 1325*b*, to be located at a same height as the sub axial bearing surface 1321*a* of the sub plate portion 1321. Accordingly, a portion of the second sub back pressure pocket 1325*b* may form the sub axial bearing surface 1321*a*, to expand a support area for an axial lower surface of the vane 1351, 1352, 1353. With this structure, the sub vane support protrusion 1327 may effectively suppress or prevent axial tilting of the vane 1351, 1352, 1353 that passes the contact point P1 and/or near the contact point P1. The sub vane support protrusion 1327 will be described hereinafter together with the main vane support protrusion 1317.

In addition, an oil supply groove (hereinafter, referred to as sub oil supply groove) 1328 may be formed in the sub axial bearing surface 1321*a* of the sub plate portion 1321, and at least a portion of the sub oil supply groove 1328 may radially overlap the sub vane support protrusion 1327. For example, one or a first end of the sub oil supply groove 1328 may communicate with the second sub back pressure pocket 1325*b*, and another or a second end of the sub oil supply groove 1328 may extend to surround a radial outside of the second sub back pressure pocket 1325*b*. In this case, the second end of the sub oil supply groove 1328 may extend in the circumferential direction to be closer to the contact point P1 than the second sub back pressure pocket 1325*b*. Accordingly, a portion of the sub oil supply groove 1328 may overlap the sub vane support protrusion 1327 in the radial direction, to provide lubrication between the bearing surface of the sub vane support protrusion 1327 and the axial lower surface of the vane 1351, 1352, 1353 facing the bearing surface.

The sub bush portion 1322 may be formed in a hollow bush shape, and an oil groove 1322*c* may be formed in an inner circumferential surface of the sub bearing hole 1322*a* that defines an inner circumferential surface of the sub bush portion 1322. The oil groove 1322*c* may be formed, for example, in a linear or inclined shape between upper and lower ends of the sub bush portion 1322 to communicate with the second oil passage hole 126*b* of the rotational shaft 123.

Although not illustrated in the drawings, the back pressure pocket 1325*a*, 1325*b* may be disposed only in any one of the main bearing 131 or the sub bearing 132. Even in this case, the vane support protrusion 1317, 1327, which will be described hereinafter, may be formed only in a bearing in which the back pressure pocket 1315*b*, 1325*b* is formed.

Referring to FIGS. 1 to 3, the cylinder 133 according to an embodiment may be in close contact with the main axial bearing surface 1311*a* of the main bearing 131 and the sub axial bearing surface 1321*a* of the sub bearing 132 and coupled by, for example, bolts to the main bearing 131 together with the sub bearing 131. Accordingly, the cylinder 133 may be fixedly coupled to the casing 110 by the main bearing 131.

The cylinder 133 may be formed in an annular shape having a hollow space in its center to define the compression space V. The hollow space may be sealed by the main bearing 131 and the sub bearing 132 to define the compression space V, and the roller 134 described hereinafter may be rotatably coupled to the compression space V.

The cylinder 133 may be provided with a suction port 1331 that penetrates from an outer circumferential surface to an inner circumferential surface thereof. However, the suction port 1331 may alternatively be formed through the main bearing 131 or the sub bearing 132.

The suction port 1331 may be formed at one or a first side of the contact point P1 described hereinafter in the circumferential direction. The discharge port 1313 described above may be formed through the main bearing 131 at another or a second side of the contact point P1 in the circumferential direction which is opposite to the suction port 1331.

The inner circumferential surface of the cylinder 133 may be formed in an elliptical shape. The inner circumferential surface of the cylinder 133 according to an embodiment may be formed in an asymmetric elliptical shape in which a plurality of ellipses, for example, four ellipses having different major and minor ratios are combined to have two origins.

Referring to FIGS. 1 to 3, the roller 134 may be rotatably disposed in the compression space V of the cylinder 133, and the plurality of vanes 1351, 1352, 1353 described hereinafter may be inserted in the roller 134 at preset or predetermined gaps along the circumferential direction. Accordingly, the compression space V may be partitioned into as many compression chambers as the number of the plurality of vanes 1351, 1352, and 1353. This embodiment illustrates an example in which the plurality of vanes 1351, 1352, and 1353 includes three vanes, and thus, the compression space V is partitioned into three compression chambers V1, V2, and V3.

The outer circumferential surface of the roller 134 according to this embodiment may be formed in a circular shape, and the rotational shaft 123 may extend as a single body from or may be post-assembled and coupled to a rotational center Or of the roller 134. Accordingly, the rotational center Or of the roller 134 is coaxially located with an axial center (no reference numeral) of the rotational shaft 123, and the roller 134 rotates concentrically with the rotational shaft 123.

However, as described above, as an inner circumferential surface of the cylinder 133 is formed in an asymmetric elliptical shape biased in a specific direction, the rotational center Or of the roller 134 may be eccentrically disposed with respect to an outer diameter center of the cylinder 133. Accordingly, one or a first side of an outer circumferential surface of the roller 134 may be almost brought into contact with the inner circumferential surface of the cylinder 133, thereby defining the contact point P1.

In addition, the plurality of vane slots 1341*a*, 1341*b*, and 1341*c* may be formed in the outer circumferential surface of the roller 134 to be spaced apart from each other in the circumferential direction. The plurality of vanes 1351, 1352, and 1353 described hereinafter may be slidably inserted into the plurality of vane slots 1341*a*, 1341*b*, and 1341*c*, respectively.

The plurality of vane slots 1341*a*, 1341*b*, and 1341*c* may be defined as first vane slot 1341*a*, second vane slot 1341*b*, and third vane slot 1341*c* along a compression-proceeding direction (a rotational direction of the roller). The first vane slot 1341*a*, the second vane slot 1341*b*, and the third vane slot 1341*c* may be formed in the same manner at equal or unequal intervals along the circumferential direction.

For example, each of the vane slots 1341*a*, 1341*b*, and 1341*c* may be inclined by a preset or predetermined angle with respect to the radial direction, so as to secure a sufficient length of each of the vanes 1351, 1352, and 1353. Accordingly, when the inner circumferential surface of the cylinder 133 is formed in the asymmetric elliptical shape, separation of the vanes 1351, 1352, and 1353 from the vane slots 1341*a*, 1341*b*, and 1341*c* may be suppressed or prevented even if a distance from the outer circumferential surface of the roller 134 to the inner circumferential surface of the cylinder 133 increases. This may result in enhancing freedom of design for the inner circumferential surface 1332 of the cylinder 133.

A direction in which the vane slots 1341*a*, 1341*b*, and 1341*c* are inclined may be a reverse direction to the rotational direction of the roller 134. That is, front end surfaces of the vanes 1351, 1352, and 1353 in contact with the inner circumferential surface of the cylinder 133 may extend in the rotational direction of the roller 134. This may be advantageous in that a compression start angle may be formed ahead in the rotational direction of the roller 134 so that compression may start quickly.

The back pressure chambers 1342*a*, 1342*b*, and 1342*c* may be configured to communicate with inner ends of the vane slots 1341*a*, 1341*b*, and 1341*c*, respectively. The back pressure chambers 1342*a*, 1342*b*, and 1342*c* may be spaces in which oil (or refrigerant) of discharge pressure or intermediate pressure is filled to flow toward rear sides of the vanes 1351, 1352, and 1353, that is, vane rear end portions 1351*c*, 1352*c*, and 1353*c*. The vanes 1351, 1352, and 1353 may be pressed toward the inner circumferential surface of the cylinder 133 by the pressure of the oil (or refrigerant) filled in the back pressure chambers 1342*a*, 1342*b*, and 1342*c*. For convenience, hereinafter, a direction toward the cylinder 133 based on a movement direction of the vanes 1351, 1352, and 1353 may be defined as a front side and an opposite side as a rear side.

The back pressure chamber 1342*a*, 1342*b*, 1342*c* may be hermetically sealed by the main bearing 131 and the sub bearing 132. The back pressure chambers 1342*a*, 1342*b*, and 1342*c* may independently communicate with each of the back pressure pockets [1315*a*, and 1315*b*], [1325*a*, and 1325*b*], and may also communicate with each other through the back pressure pockets [1315*a*, and 1315*b*], and [1325*a*, and 1325*b*]

Referring to FIGS. 1 to 3, the plurality of vanes 1351, 1352, and 1353 according to this embodiment may be slidably inserted into the respective vane slots 1341*a*, 1341*b*, and 1341*c*. Accordingly, the plurality of vanes 1351, 1352, and 1353 may have substantially a same shape as the respective vane slots 1341*a*, 1341*b*, and 1341*c*.

For example, the plurality of vanes 1351, 1352, and 1353 may be defined as first vane 1351, second vane 1352, and third vane 1353 along the rotational direction of the roller 134. The first vane 1351 may be inserted into the first vane slot 1341*a*, the second vane 1352 may be inserted into the second vane slot 1341*b*, and the third vane 1353 may be inserted into the third vane slot 1341*c*, respectively.

The plurality of vanes 1351, 1352, and 1353 may have substantially a same shape. More specifically, each of the plurality of vanes 1351, 1352, and 1353 may be formed substantially in a rectangular parallelepiped shape. The front end surface 1351*a*, 1352*a*, 1353*a* in contact with the inner circumferential surface of the cylinder 133 may be formed as a curved surface and the rear end surface 1351*b*, 1352*b*, 1353*b* facing the back pressure chamber 1342*a*, 1342*b*, 1342*c* may be formed as a linear surface.

Additionally, oil supply guide grooves 1351*c*, 1352*c*, 1353*c* that extend along a longitudinal direction may be formed in both axial side surfaces of the vane 1351, 1352, 1353. For example, the oil supply guide grooves 1351*c*, 1352*c*, 1353*c* may extend from a rear end to a front end of the vane 1351, 1352, 1353 by a preset or predetermined length. In other words, the oil supply guide grooves 1351*c*, 1352*c*, 1353*c* may be formed so that at least portions thereof communicate with the back pressure pockets 1315*b*, 1325*b*, respectively, without overlapping the vane support protrusions 1317, 1327. Accordingly, oil in the back pressure pockets 1315*b*, 1325*b* may be supplied to the axial bearing surfaces 1311*a*, 1321*a* between the vane 1351, 1352, 1353 and the vane support protrusions 1317, 1327 through the oil supply guide grooves 1351*c*, 1352*c*, 1353*c*. With this structure, even if a contact area between the vane support protrusions 1317 and 1327 and the axial bearing surfaces 1311*a* and 1321*a* facing them increases, friction loss and wear between the vane 1351, 1352, 1353 and the axial bearing surfaces 1311*a* and 1321*a* may be effectively suppressed or prevented.

Hereinafter, operation of the concentric rotary compressor with the hybrid cylinder will be described.

That is, when power is applied to the drive motor 120, the rotor 122 of the drive motor 120 and the rotational shaft 123 coupled to the rotor 122 rotate together, causing the roller 134 coupled to the rotational shaft 123 or integrally formed therewith to rotate together with the rotational shaft 123. Then, the plurality of vanes 1351, 1352, and 1353 may be drawn out of the vane slots 1341*a*, 1341*b*, and 1341*c* by centrifugal force generated by the rotation of the roller 134 and back pressure of the back pressure chambers 1342*a*, 1342*b*, and 1342*c*, which support the rear end surfaces 1351*b*, 1353*b*, 1353*b* of the vanes 1351, 1352, and 1353, thereby being brought into contact with the inner circumferential surface of the cylinder 133.

The compression space V of the cylinder 133 may be partitioned by the plurality of vanes 1351, 1352, and 1353 into as many compression chambers (including a suction chamber or a discharge chamber) V1, V2, and V3 as the number of the vanes 1351, 1352, and 1353. The compression chambers V1, V2, and V3 may be changed in volume by the shape of the inner circumferential surface of the cylinder 133 and eccentricity of the roller 134 while moving in response to the rotation of the roller 134. Accordingly, refrigerant suctioned into the respective compression chambers V1, V2, and V3 may be compressed while moving along the roller 134 and the vanes 1351, 1352, and 1353, and discharged into the inner space of the casing 110. Such series of processes are repeatedly carried out.

As described above, in the rotary compressor according to the embodiment, the main back pressure pocket 1315*a*, 1315*b* and the sub back pressure pocket 1325*a*, 1325*b* may be formed on the main bearing and sub bearing, respectively, to axially overlap each vane 1351, 1352, 1353. This decreases the axial support area for the rear end side of the vane 1351, 1352, 1353. As a result, axial behavior of the vane 1351, 1352, and 1353 becomes unstable and the vane tilts. This causes friction loss and wear between axial side surfaces of the vane 1351, 1352, 1353, and the main axial bearing surface 1311*a* and/or the sub axial bearing surface 1321*a* facing the axial side surfaces, thereby increasing vibration noise and lowering compression efficiency. This may occur particularly at the contact point P1 and/or near the contact point P1 where the vane 1351, 1352, 1353 is subject to a high gas force, for example, between the contact point P1 and the suction port 1331.

Accordingly, in this embodiment, the vane support protrusion may be formed to extend inside of the back pressure pocket to support the vane in the axial direction, to secure a wide vane support area. This may stabilize the axial behavior of the vane to suppress or prevent friction loss and/or wear between the axial side surface of the vane and the main axial bearing surface and/or the sub axial bearing surface. Hereinafter, description will be focused on an example in which the vane support protrusions are formed on the main bearing and the sub bearing, respectively. The main vane support protrusion disposed on the main bearing will be described mainly and the sub vane support protrusion disposed on the sub bearing will be briefly described with reference to the description of the main vane support protrusion.

Figure 4:
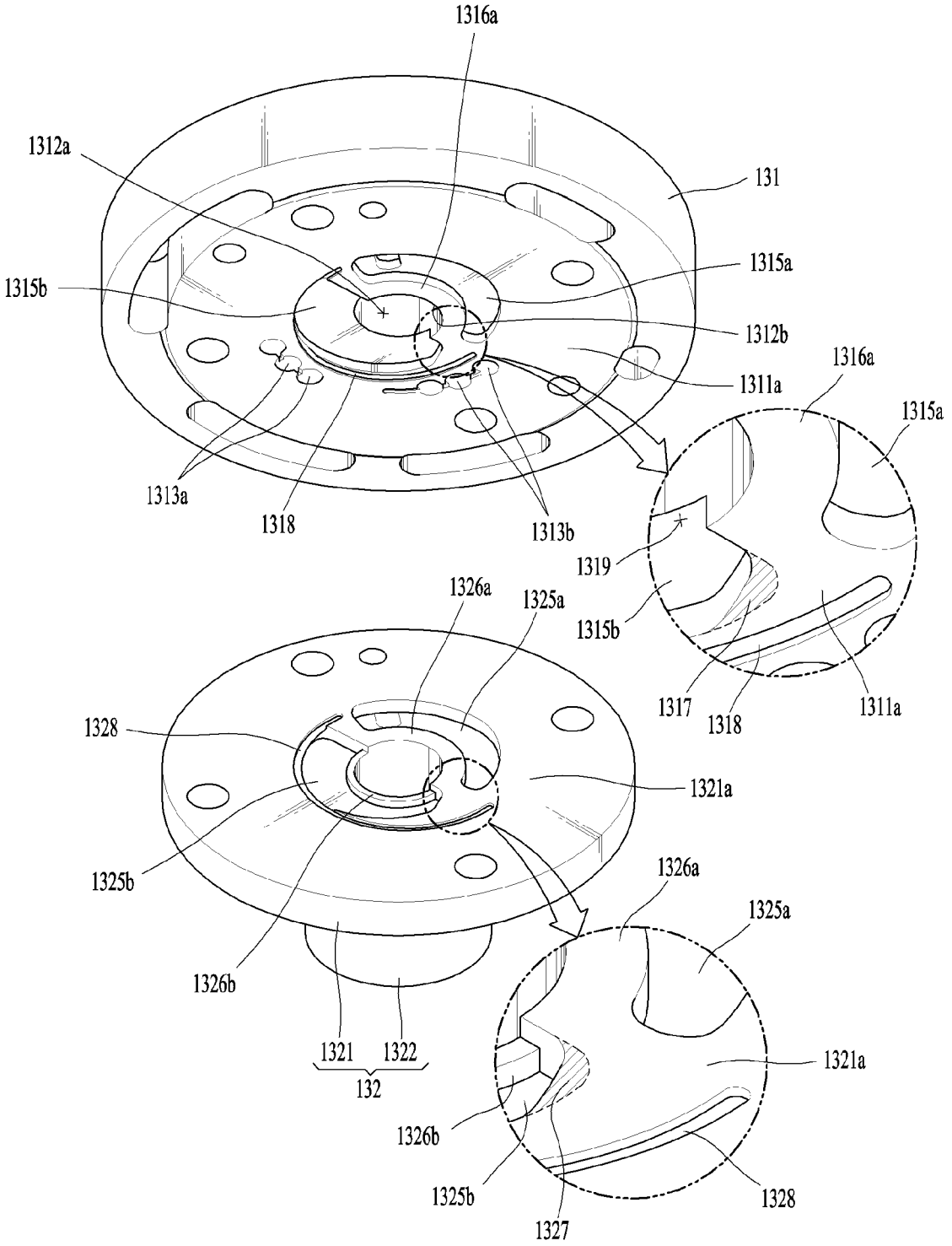
FIG. 4 is a perspective view of a main bearing and a sub bearing each having a vane support protrusion according to an embodiment.
Figure 5:
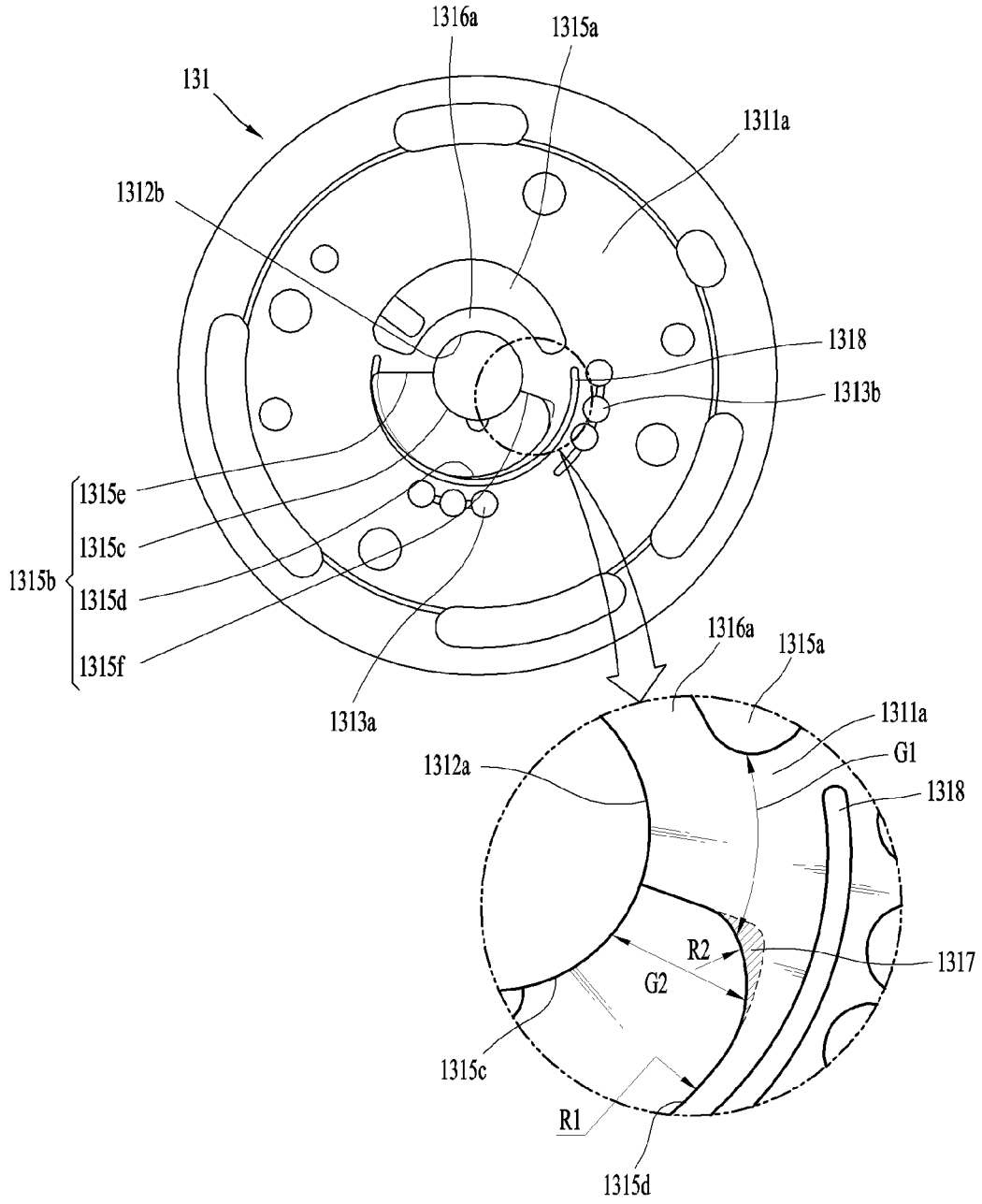
FIG. 5 is a planar view of the main bearing in FIG. 4.
Figure 6:
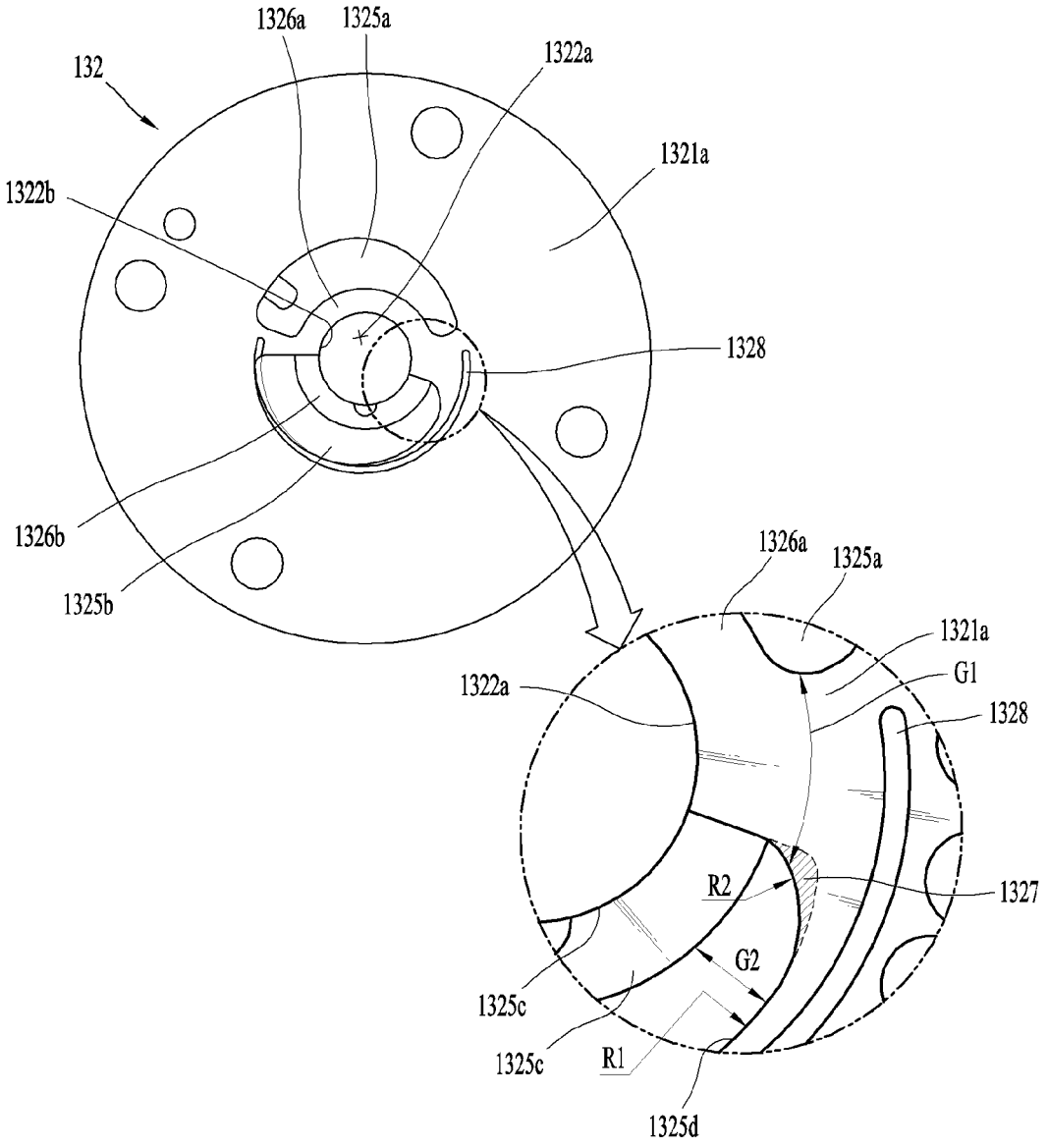
FIG. 6 is a planar view of the sub bearing in FIG. 4.
Figure 7:
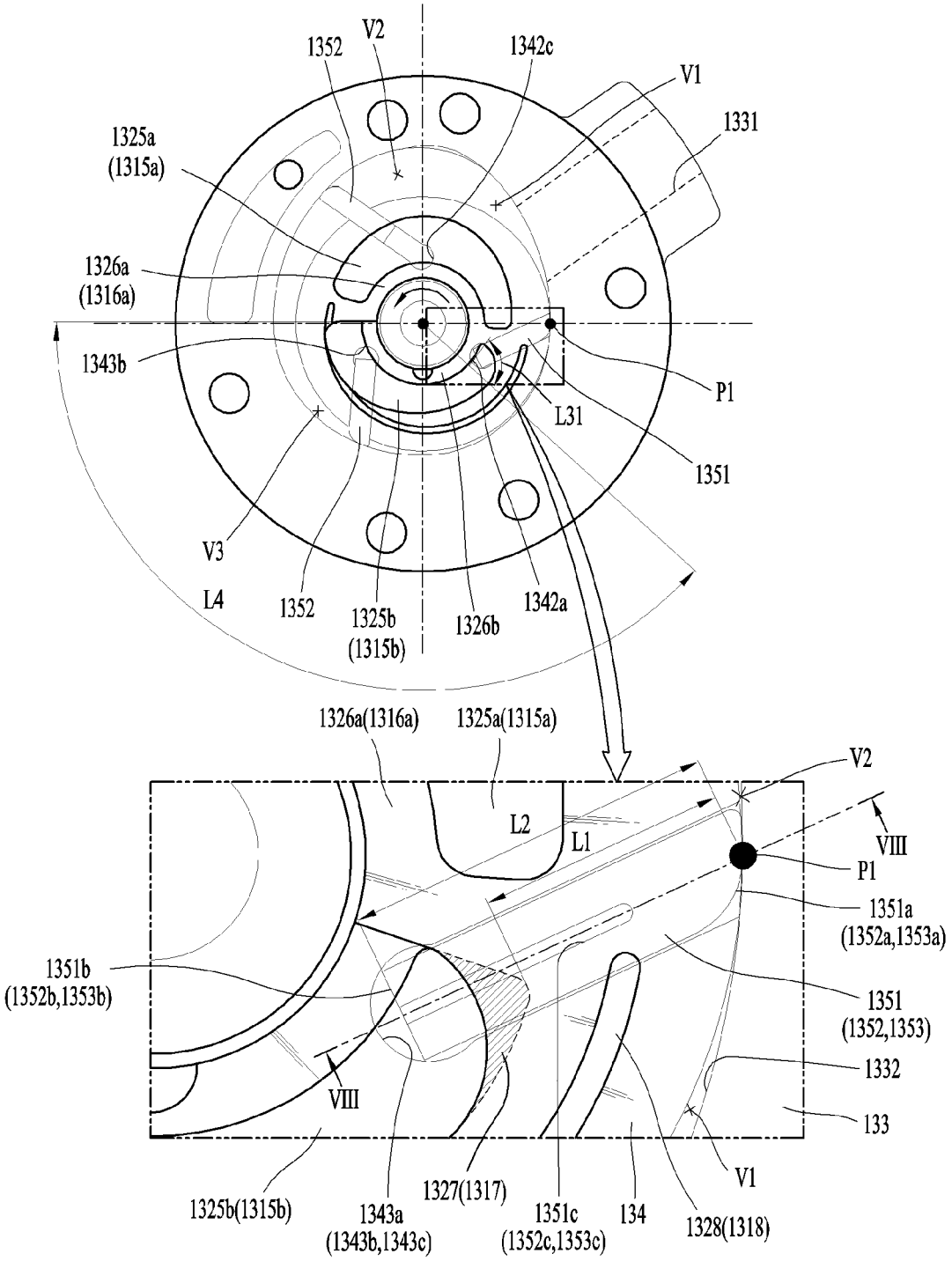
FIG. 7 is a schematic view for explaining an effect of a vane support protrusion according to an embodiment.
Figure 8:
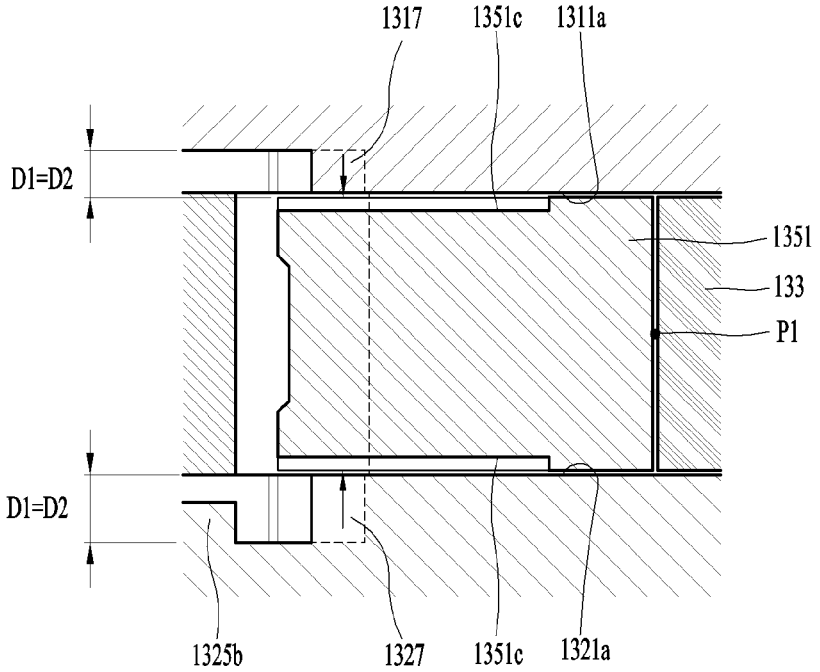
FIG. 8 is a cross-sectional view, taken along line "VIII-VIII" of FIG. 7.
Figure 9:
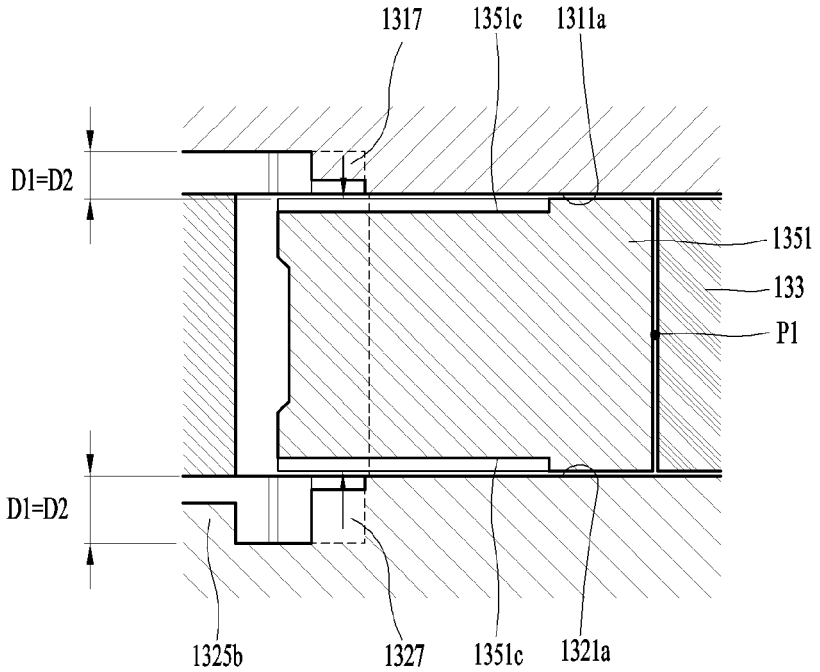
FIG. 9 is a cross-sectional view illustrating a variation for the vane support protrusion of FIG. 7.

FIG. 4 is a perspective view of a main bearing and a sub bearing each having a vane support protrusion according to an embodiment. FIG. 5 is a planar view of the main bearing in FIG. 4. FIG. 6 is a planar view of the sub bearing in FIG. 4. FIG. 7 is a schematic view for explaining an effect of the vane support protrusion according to an embodiment. FIG. 8 is a cross-sectional view, taken along the "VIII-VIII" of FIG. 7. FIG. 9 is a cross-sectional view of a variation for the vane support protrusion of FIG. 7.

Referring back to FIGS. 1 and 3, the main bearing 131 according to this embodiment may include the main plate portion 1311 and the main bush portion 1312 as described above. The main plate portion 1311 may be formed in an annular disc shape, and the main bush portion 1312 may be formed in a cylindrical shape extending from a central area of the main plate portion 1311 toward the drive motor 120.

The first main back pressure pocket 1315*a* and the second main back pressure pocket 1315*b* having different pressures may be formed, as described above, on one side surface of the main plate portion 1311, that is, the main axial bearing surface 1311*a* facing the roller 134. In other words, the first main back pressure pocket 1315*a* and the second main back pressure pocket 1315*b* may be formed in an arcuate shape with a preset or predetermined gap therebetween along the circumferential direction, but may be located on a virtual circle C connecting the respective back pressure chambers 1342*a*, 1342*b*, 1342*c*. Accordingly, the first main back pressure pocket 1315*a* may communicate with the first sub back pressure pocket 1325*a* through each back pressure chamber 1342*a*, 1342*b*, 1342*c*, and the second main back pressure pocket 1315*b* may communicate with the second sub back pressure pocket 1325*b* through each back pressure chamber 1342*a*, 1342*b*, 1342*c*.

Referring to FIGS. 4 and 5, at least one of the first main back pressure pockets 1315*a* or the second main back pressure pocket 1315*b* may include the vane support protrusion 1317 that supports the vane 1351, 1352, 1353 passing through the corresponding back pressure pocket in the axial direction. In this embodiment, description will focus on an example in which the vane support protrusion 1317 is formed in the second main back pressure pocket 1315*b* adjacent to the contact point P1.

Referring to FIG. 5, the second main back pressure pocket 1315*b* may be formed in an approximately arcuate shape when projected in the axial direction, and may be recessed by a preset or predetermined depth into the main axial bearing surface 1311*a* forming one axial side surface of the main plate portion 1311. In other words, the inner circumferential surface of the second main back pressure pocket 1315*b* may include an inner wall surface 1315*c*, an outer wall surface 1315*d*, and a first side wall surface 1315*e* and a second side wall surface 1315*f* that connect ends of the inner wall surface 1315*c* and the outer wall surface 1315*d* in the circumferential direction, and the inner wall surface 1315*c* and the outer wall surface 1315*d* may each be formed in an arcuate shape. Accordingly, the second main back pressure packet 1315*b* may generally have a cross-section in an arcuate shape.

However, the inner wall surface 1315*c* may be open toward the outer circumferential surface of the rotational shaft 123, while the outer wall surface 1315*d* and both side wall surfaces may be closed toward the inner circumferential surface of the cylinder 133. In other words, the second main back pressure pocket stores oil in a space defined by the outer wall surface 1315*d* and both the side wall surfaces even if the inner wall surface 1315*c* is open. Accordingly, the inner wall surface 1315*c* of the second main back pressure pocket is open and does not actually form a wall surface, but hereinafter, an open portion radially facing the outer wall surface 1315*d* is defined as the inner wall surface 1315*c*.

As described above, the inner wall surface 1315*c* of the second main back pressure pocket 1315*b* is a surface where the second main back pressure pocket 1315*b* is open toward the inner circumferential surface of the rotational shaft 123, and thus, has a same curvature as the main radial bearing surface 1312*a* on a same axial line as a roller center Or. Accordingly, an inlet of the second main back pressure pocket 1315*b* may be completely open toward the oil passage 125 (more specifically, the first oil passage hole) of the rotational shaft 123, enabling quick and smooth flow of oil into the second main back pressure pocket 1315*b*.

Although not illustrated, a second main bearing support protrusion (not illustrated) forming the inner wall surface 1315*c* may be formed to protrude in the axial direction from the inner circumferential surface of the second main back pressure pocket 1315*b*. In this case, the second main bearing support protrusion may be formed lower than the main axial bearing surface 1311*a* to secure an inlet area of the second main back pressure pocket 1315*b*.

The outer wall surface 1315*d* of the second main back pressure pocket 1315*b* may be formed eccentrically with respect to the center of the main radial bearing surface 1312*a*, that is, the roller center Or. In other words, the outer wall surface 1315*d* of the second main back pressure pocket 1315*b* may be formed such that its center is eccentric away from the contact point P1 with respect to a center of the inner wall surface 1315*c*, which is concentric with the main radial bearing surface 1312*a*. Accordingly, the outer wall surface 1315*d* of the second main back pressure pocket 1315*b* may be spaced apart from the inner circumferential surface of the cylinder 133 approximately by the same gap, while getting closer toward the contact point P1 from the inner wall surface 1315*c* of the second main back pressure pocket 1315*b*.

The first side wall surface 1315*e* of the second main back pressure pocket 1315*b* may be a surface defining one or a first side surface in the circumferential direction, which is far away from the contact point P1, and may be formed as a flat (linear, straight) surface extending in the radial direction. Accordingly, the first side wall surface 1315*e* of the second main back pressure pocket 1315*b* may be spaced apart from the neighboring first main back pressure pocket 1315*a* by the same gap in the radial direction and secure a volume of the second main back pressure pocket 1315*b* as wide as possible.

The second side wall surface 1315*f* of the second main back pressure pocket 1315*b* may be a surface defining another or a second side surface in the circumferential direction, which is close to the contact point P1, and may be formed as an arcuate surface with a preset or predetermined curvature or as a linear surface. This embodiment will be described focusing on an example in which the second side wall surface 1315*f* of the second main back pressure pocket 1315*b* is formed as an arcuate surface.

For example, the second side wall surface 1315*f* of the second main back pressure pocket 1315*b* may connect an end of the inner wall surface 1315*c* close to the contact point P1 and an end of the outer wall surface 1315*d* close to the contact point P1, and the inner circumferential surface of the main vane support protrusion 1317 formed in an area where the outer wall surface 1315*d* and the second side wall surface 1315*f* of the second main back pressure pocket 1315*b* meet may be formed as a curved surface having a second curvature R2. In other words, the second curvature R2 formed by the inner circumferential surface of the main vane support protrusion 1317 may be different from a first curvature R1 formed by the outer wall surface 1315*d* of the second main back pressure pocket 1315*b*.

More specifically, a center of the second curvature R2 formed by the inner circumferential surface of the main vane support protrusion 1317 may be spaced apart from a center of the first curvature R1 formed by the outer wall surface 1315*d* of the second main back pressure pocket 1315*b*, and the second curvature R2 may be larger than the first curvature R1. Accordingly, the main vane support protrusion 1317 may extend in a direction toward a geometric center of the second main back pressure pocket 1315*b*, for example, along the reciprocating direction of the vane 1351, 1352, 1353, thereby increasing the main axial bearing surface 1311*a*.

In other words, the main vane support protrusion 1317 may be formed as the second side wall surface 1315*f* and the outer wall surface 1315*d* of the second main back pressure pocket 1315*b* extend toward the inner wall surface 1315*c* along the reciprocating direction of the vane 1351, 1352, 1353. The main vane support protrusion 1317 may protrude in the axial direction from a bottom surface of the second main back pressure pocket 1315*b* and extend at the main axial bearing surface 1311*a*. Accordingly, a circumferential gap G1 between the first main back pressure pocket 1315*a* and the second main back pressure pocket 1315*b* may be gradually decreased from the outer wall surface 1315*d* toward the inner wall surface 1315*c*. In other words, a radial gap G2 between the inner wall surface 1315*c* and the outer wall surface 1315*d* of the first main back pressure pocket 1315*a* (and the second main back pressure pocket 1315*b*) may be gradually decreased toward the contact point P1. With this structure, the main vane support protrusion 1317 may be formed to correspond to a movement path of the vane 1351, 1352, 1353, thereby stably supporting the rear end of the vane. In other words, an area of the main axial bearing surface 1311*a* between the first main back pressure pocket 1315*a* and the second main back pressure pocket 1315*b* formed near the contact point P1 may be increased, to thus effectively suppress or prevent axial tilting of the vane 1351, 1352, 1353 passing the contact point P1.

In this case, as illustrated in FIG. 7, a shortest distance L1 from the contact point P1 to the main vane support protrusion 1317 may be formed to be 0.7 to 0.9 times a length L2 of the vane 1351, 1352, 1353. This may secure a substantial axial support area for the rear end of the vane 1351, 1352, 1353 at the contact point P1 and/or in the vicinity of the contact point P1.

In addition, the main vane support protrusion 1317 according to this embodiment may be formed so that its arcuate length L31 is smaller than or equal to an arcuate length L4 of the outer wall surface 1315*d* of the second main back pressure pocket 1315*b*. This may result in securing an axial support area for the vane 1351, 1352, 1353 passing near the contact point P1 and prevent a volume of the second main back pressure pocket 1315*b* from being excessively reduced.

In other words, the main vane support protrusion 1317 may be formed so that at least a portion thereof is located in a discharge section S1 of the compression chamber. For example, as illustrated in FIG. 7, the main vane support protrusion 1317 may be formed to overlap the discharge section of the compression chamber, but the arcuate length L31 of the main vane support protrusion 1317 may be shorter than a length of the discharge section S1. Accordingly, an excessive increase in the area of the axial bearing surface 1311*a* for the vane 1351, 1352, 1353 located far from the contact point P1 may be suppressed or prevented, thereby reducing friction loss that may be unnecessarily caused.

Also, the main vane support protrusion 1317 according to an embodiment may be formed at a same height as the main axial bearing surface 1311*a*. For example, as illustrated in FIG. 8, the main vane support protrusion 1317 may be formed to be flush with the main axial bearing surface 1311*a*. Accordingly, the axial support area for the vane 1351, 1352, 1353 passing near the contact point P1 may be expanded by the area of the main vane support protrusion 1317, so that the vane 1351, 1352, 1353 passing near the contact point P1 may be supported stably.

However, in some cases, the main vane support protrusion 1317 according to an embodiment may be formed at a different height from the main axial bearing surface 1311*a*. For example, as illustrated in FIG. 9, the main vane support protrusion 1317 may be formed stepwise to be lower than the main axial bearing surface 1311*a*. Accordingly, oil in the second main back pressure pocket 1315*b* may be filled between the upper surface of the main vane support protrusion 1317 and the lower surface of the corresponding vane 1351, 1352, 1353 facing it, to improve a lubricating effect for the vane 1351, 1352, 1353 that passes the contact point P1.

Referring to FIGS. 4 and 6, the vane support protrusion may be formed in the same way on the sub bearing 132. In other words, the vane support protrusion (hereinafter, referred to as 'sub vane support protrusion') 1327 may extend in the axial direction from a bottom surface of the second sub back pressure pocket 1325*b*. The sub vane support protrusion 1327 may laterally extend from the inner circumferential surface of the second sub back pressure pocket 1325*d* (for example, an area where the second side wall surface and the outer wall surface meet) along the reciprocating direction of the vane 1351, 1352, 1353. In this case, the sub vane support protrusion 1327 may be formed symmetrically to the main vane support protrusion 1317 of the main bearing 131 described above. Accordingly, description of the sub vane support protrusion 1327 will be replaced by the explanation of the main vane support protrusion 1317.

However, the second sub bearing protrusion 1326*b* may protrude from the sub bearing 132 by a preset or predetermined height, to be lower than the sub axial bearing surface 1321*a*. Accordingly, as the inner wall surface (no reference numeral) of the second sub back pressure pocket 1325*b* protrudes by the preset height, foreign substances introduced into the second sub back pressure pocket 1325*b* may be prevented from escaping to the bearing surface.

Additionally, the previously described vane support protrusion may be formed only on the sub bearing 132. In other words, the main vane support protrusion (not illustrated) may be excluded and only the sub vane support protrusion 1327 may be formed. Even in this case, the sub vane support protrusion 1327 may be formed to be the same as the main vane support protrusion 1317 described above. Accordingly, description of the sub vane support protrusion 1327 will also be replaced by the explanation of the main vane support protrusion 1317.

In this way, in the rotary compressor according to an embodiment, the support area for the axial side surface of the vane may be increased by forming the vane support protrusion on the main bearing and/or sub bearing. Accordingly, the vane may be prevented from tilting in the axial direction during operation so as to suppress or prevent wear of the axial bearing surface of the main bearing, the axial bearing surface of the sub bearing, the inner circumferential surface of the cylinder, and/or the front end surface of the vane. This may reduce vibration noise in a specific area and also suppress or prevent leakage between compression chambers, thereby enhancing compression efficiency. In addition, tilting of the vane which may occur more severely at the beginning of operation of the compressor may be effectively suppressed or prevented, thereby preventing a defective initial startup. In addition, when it is applied to an air conditioning device, air-conditioning effects may be quickly exhibited.

In addition, in the rotary compressor according to an embodiment, the oil supply groove may be formed in the main bearing and/or the sub bearing to overlap the vane support protrusion or the oil supply guide groove may be formed in the axial side surface of the vane, thereby increasing the support area between the vane and the axial bearing surface and suppressing friction loss and/or wear between the vane and the axial bearing surface.

The effects described above may be further expected in the rotary compressor according to the embodiment when a high-pressure refrigerant, such as R32, R410a, or $CO_2$ is used.

Hereinafter, description will be given of a vane support protrusion according to another embodiment. That is, in the previous embodiment, the vane support protrusion extends from the inner circumferential surface of the back pressure pocket along the reciprocating direction of the vane, but in some cases, the vane support protrusion may be formed to protrude from the back pressure pocket in the axial direction.

Figure 10:
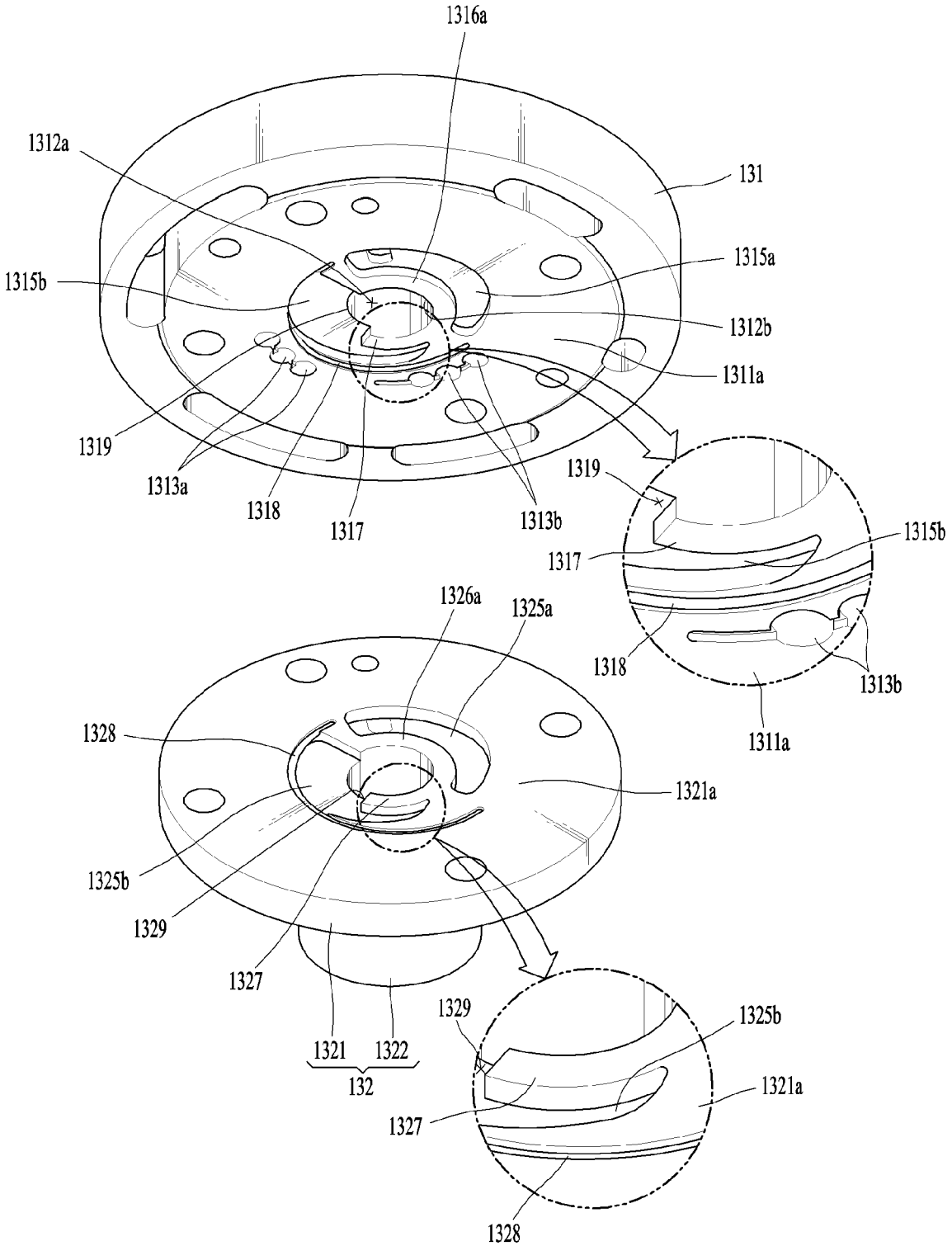
FIG. 10 is a perspective view of a main bearing and a sub-bearing each having a vane support protrusion according to another embodiment.
Figure 11:
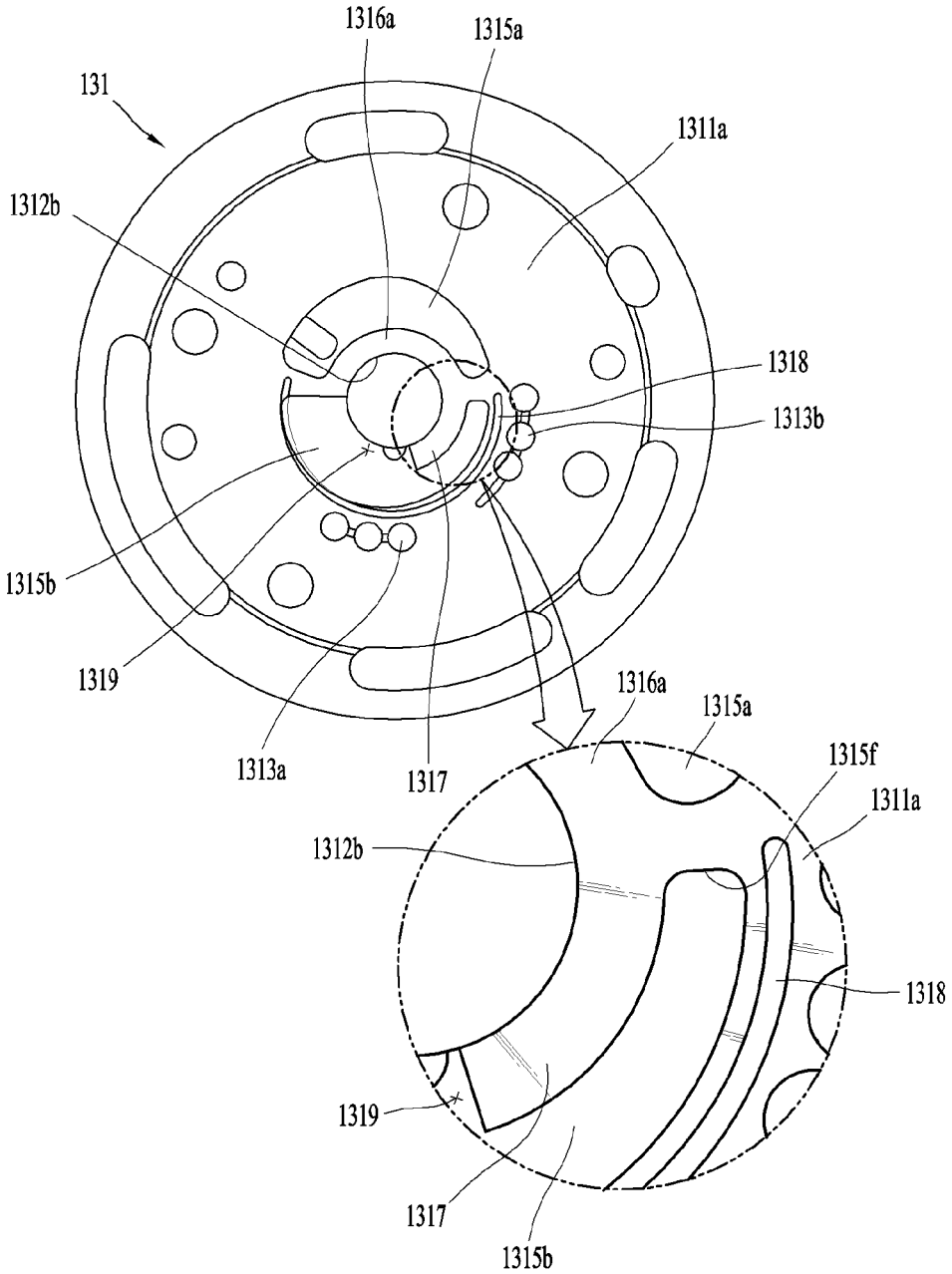
FIG. 11 is a planar view of the main bearing in FIG. 10.
Figure 12:
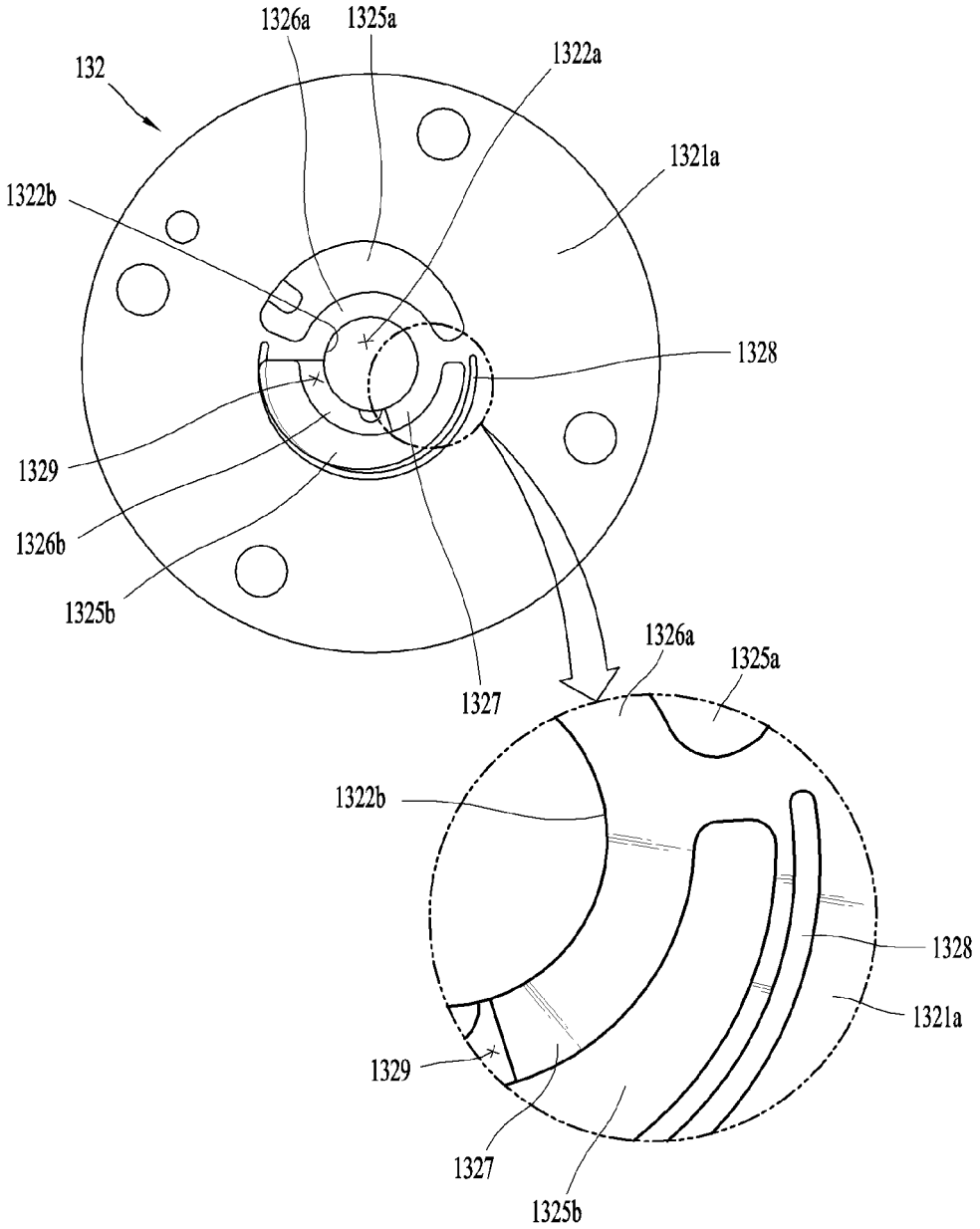
FIG. 12 is a planar view of the sub bearing in FIG. 10.
Figure 13:
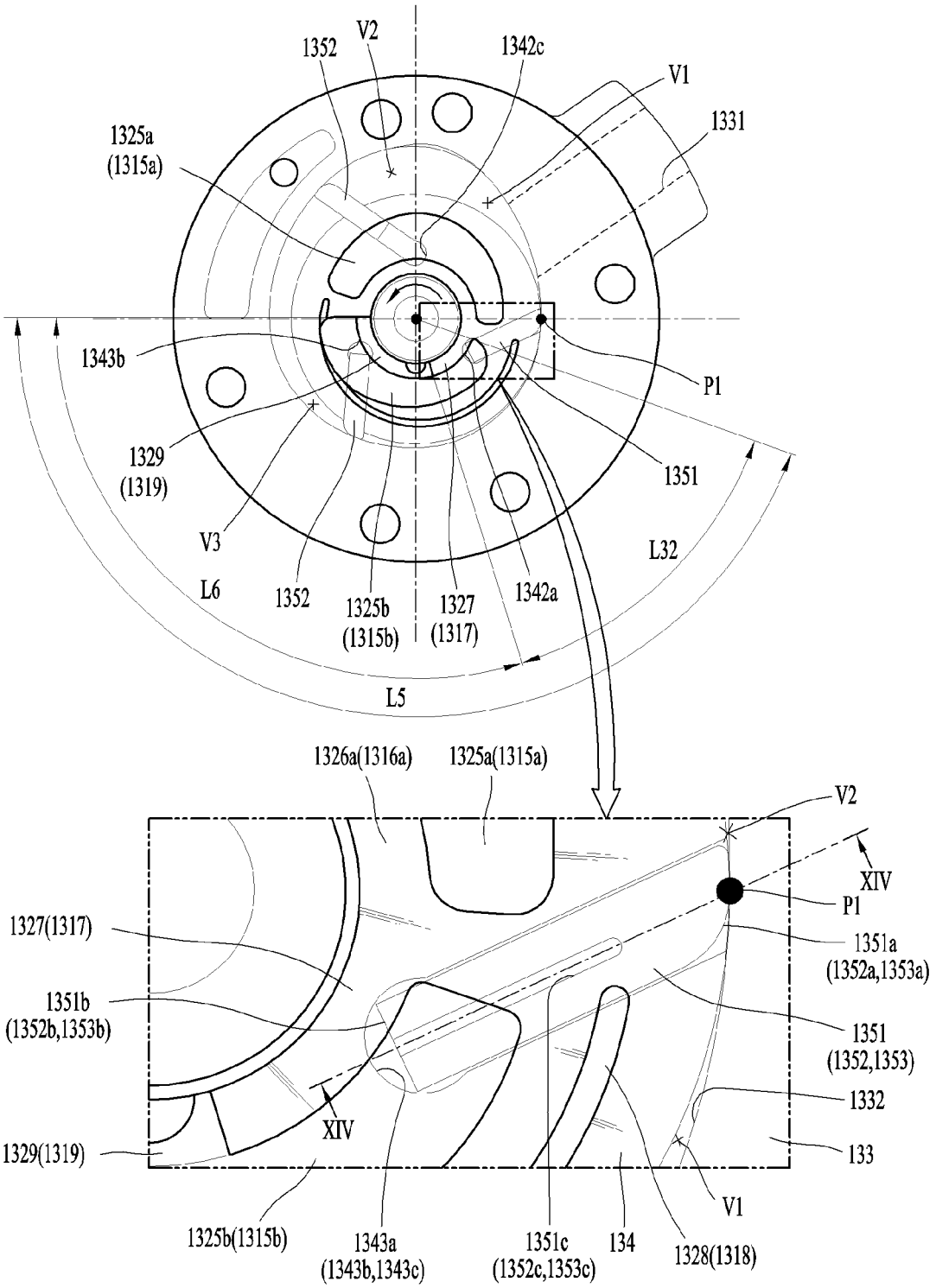
FIG. 13 is a schematic view for explaining an effect of the vane support protrusion in FIG. 10.
Figure 14:
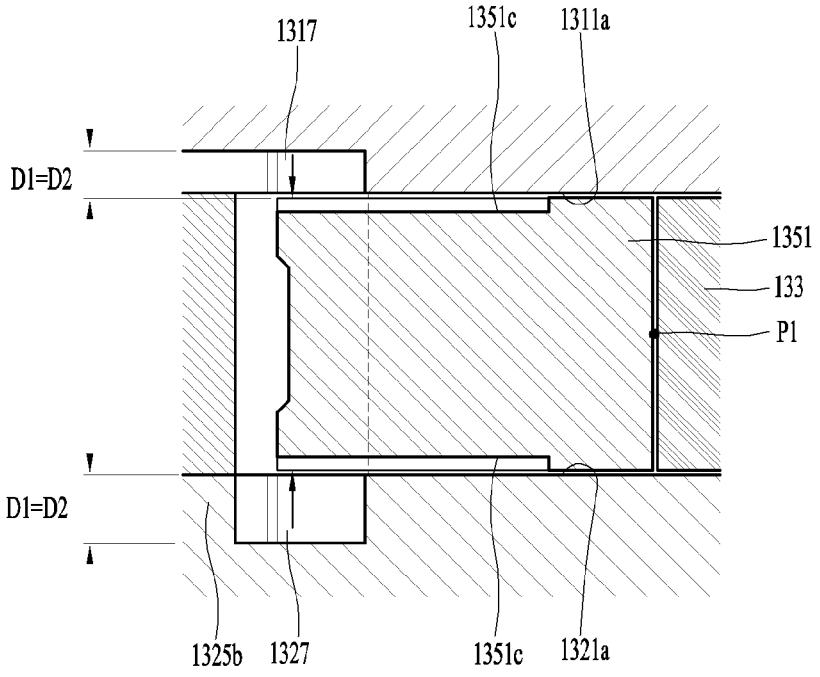
FIG. 14 is a cross-sectional view, taken along line "XIV-XIV" of FIG. 13.

FIG. 10 is a perspective view illustrating a main bearing and a sub-bearing each having a vane support protrusion according to another embodiment. FIG. 11 is a planar view illustrating the main bearing in FIG. 10. FIG. 12 is a planar view illustrating the sub bearing in FIG. 10. FIG. 13 is a schematic view for explaining an effect of the vane support protrusion in FIG. 10, and FIG. 14 is a cross-sectional view, taken along line "XIV-XIV" of FIG. 13.

Referring to FIGS. 10 to 14, as the basic configuration and operating effects of the vane rotary compressor according to this embodiment are almost the same as those of the previous embodiment, detailed description thereof will be replaced by the description of the previous embodiment. For example, at least one vane slot 1341*a*, 1341*b*, 1341*c* may be formed in the roller 134 eccentrically inserted into the cylinder 133, and the vane 1351, 1352, 1353 may be slid into the vane slot 1341*a*, 1341*b*, 1341*c*. The vane 1351, 1352, 1353 may be axially supported by the main bearing 131 and the sub bearing 132, which are coupled to the both axial sides of the cylinder 133. The back pressure pockets [1315*a* and 1315*b*], [1325*a* and 1325*b*] communicating with the oil passage 125 of the rotational shaft 123 may be formed in at least one of the main bearing 131 or the sub bearing 132. The back pressure pockets [1315*a* and 1315*b*], [1325*a* and 1325*b*] may communicate with the back pressure chamber 1342*a*, 1342*b*, 1342*c* disposed inside of the vane slot 1341*a*, 1341*b*, 1341*c*. Accordingly, high-pressure oil may be introduced into the back pressure chamber 1342*a*, 1342*b*, 1342*c* through the oil passage 125 of the rotational shaft 123 and the back pressure pockets [1315*a* and 1315*b*], [1325*a* and 1325*b*] to press the vane 1351, 1352, 1353 toward the inner circumferential surface of the cylinder 133, thereby suppressing or preventing the vane 1351, 1352, 1353 from wobbling (forward and backward wobble).

However, as described above, the back pressure pockets [1315*a* and 1315*b*], [1325*a* and 1325*b*] are recessed axially into the main axial bearing surface 1311*a* of the main bearing 131 and/or the sub axial bearing surface 1321*a* of the sub bearing 132, which results in reducing the axial support area for the vane 1351, 1352, 1353. Due to this, the axial support force for supporting the vane 1351, 1352, 1353 may be reduced, thereby causing axial tilting of the vane 1351, 1352, 1353. Especially, the vane 1351, 1352, 1353 that passes near the contact point P1 may behave unstably due to a gas repulsive force applied from the compression chamber, which may further aggravate the axial tilting of the vane 1351, 1352, 1353 near the contact point P1.

Accordingly, in this embodiment, the vane support protrusion extends from the main axial bearing surface 1311*a* and/or the sub axial bearing surface 1321*a* near the contact point P1, as in the previous embodiment. According to this embodiment, the vane support protrusion may be formed outside of the back pressure pockets [1315*a* and 1315*b*], [1325*a* and 1325*b*], so as to increase the axial support area for axially supporting the vane 1351, 1352, 1353, and simultaneously suppress reduction of the volume of the back pressure pockets [1315*a* and 1315*b*], [1325*a* and 1325*b*]. The vane support protrusion may be formed on at least one of the main bearing 131 or the sub bearing 132, but in this embodiment, an example in which the vane support protrusion is formed adjacent to the second main back pressure pocket 1315*b* of the main bearing 131, as in the previous embodiment, will be described.

Referring to FIGS. 10 and 11, the main plate portion 1311 of the main bearing 131 according to this embodiment may include, as described above, the first main back pressure pocket 1315*a* and the second main back pressure pocket 1315*b* formed along the circumferential direction to be spaced apart from each other by a preset or predetermined gap. A first main bearing protrusion 1316*a* may be formed on the inner circumferential side of the first main back pressure pocket 1315*a*, and the main vane support protrusion 1317 which defines the second main bearing protrusion (no reference numeral) formed as a partial partition wall may be formed on the inner circumferential side of the second main back pressure pocket 1315*b*. Accordingly, oil of low intermediate pressure may be filled inside of the first main back pressure pocket 1315*a* while oil of high intermediate pressure (or discharge pressure) may be filled inside of the second main back pressure pocket 1315*b*.

The main vane support protrusion 1317, as well as the first main bearing protrusion 1316*a*, may protrude in the axial direction from the main axial bearing surface 1311*a* between the first main back pressure pocket 1315*a* and the second main back pressure pocket 1315*b* and extend in the circumferential direction. Accordingly, the main vane support protrusion 1317 may not only support the vane 1351, 1352, 1353 in the axial direction, but also support the rotational shaft 123 in the radial direction together with the first main bearing protrusion 1316*a*.

The main vane support protrusion 1317 may be formed to be flush with the main axial bearing surface 1311*a*. However, in some cases, the main vane support protrusion 1317 may be formed to be lower than the main axial bearing surface 1311*a*. This embodiment illustrates an example in which the main vane support protrusion 1317 is formed at a same height as the main axial bearing surface 1311*a*, that is, the first main bearing protrusion 1316*a*.

Referring to FIG. 11, the main vane support protrusion 1317 according to this embodiment may extend from the main axial bearing surface 1311*a* in an opposite direction to the first main bearing protrusion 1316*a* between the first main back pressure pocket 1315*a* and the second main back pressure pocket 1315*b*. Accordingly, the main vane support protrusion 1317 defines the second main bearing protrusion (no reference numeral) and also defines a portion of the main axial bearing surface 1311*a*. With this structure, the main vane support protrusion 1317 may be located far away in the reciprocating direction of the vane 1351, 1352, 1353, to thus maintain the volume of the main back pressure pocket 1315*b* while securing a substantial axial support area for the rear end of the vane 1351, 1352, 1353 at the contact point P1 and/or near the contact point P1.

More specifically, the main vane support protrusion 1317 may be formed at an end portion close to the contact point P1, of both circumferential ends of the second main back pressure pocket 1315*b*. For example, the main vane support protrusion 1317 may protrude in the axial direction from the inner circumferential surface of the second main back pressure pocket 1315*b*, as in the previous embodiment. Accordingly, the main vane support protrusion 1317 defines a partial partition wall of the second main back pressure pocket 1315*b*, that is, the inner wall surface 1315*c*, and also defines the second main bearing protrusion (no reference numeral).

However, as illustrated in FIG. 13, the main vane support protrusion 1317 according to this embodiment may extend from an end portion near the contact point P1 toward an opposite end portion in the circumferential direction, and an arcuate length (or central angle) L32 of the main vane support protrusion 1317 may be formed to be approximately half or less than an arcuate length (or central angle) L5 of the inner circumferential surface of the second main back pressure pocket 1315*b*. In other words, a main oil passage groove 1319, in which the inner circumferential side of the second main back pressure pocket 1315*b* is open toward the rotational shaft 123, may be formed in one side of the main vane support protrusion 1317 in the circumferential direction. Accordingly, the main oil passage groove 1319 may form the inlet of the second main back pressure pocket 1315*b*, and the second main back pressure pocket 1315*b* may directly communicate with the oil passage (more specifically, a first oil passage hole) 123 through the main oil passage groove 1319.

The main oil passage groove 1319 may be formed such that its arcuate length (or central angle) L6 is greater than or equal to an arcuate length (or central angle) L32 of the main vane support protrusion 1317. Accordingly, the rear end of the vane 1351, 1352, 1353 passing near the contact point P1 may be supported in the axial direction, and simultaneously, oil suctioned through the oil passage 125 may be smoothly introduced into the second main back pressure pocket 1315*b*.

In addition, the main oil passage groove 1319 may be formed so that its depth D1 is smaller than or equal to a depth D2 of the second main back pressure pocket 1315*b*. For example, the main oil passage groove 1319 may be formed so that its depth D1 is equal to the depth D2 of the second main back pressure pocket 1315*b*. Accordingly, a cross-sectional area of the main oil passage groove 1319 forming the inlet of the second main back pressure pocket 1315*b* may be secured as wide as possible while the main vane support protrusion 1317 may protrude axially toward the roller 134 at the inner circumferential side of the second main back pressure pocket 1315*b*. Therefore, the rear end of the vane 1351, 1352, 1353 passing near the contact point P1 may be supported in the axial direction, and simultaneously oil suctioned through the oil passage 125 may be smoothly introduced into the second main back pressure pocket 1315*b*.

Referring to FIGS. 13 and 14, when the main vane support protrusion 1317 is formed on the inner circumferential surface of the second main back pressure pocket 1315*b* as in this embodiment, the inner circumferential side of the second main back pressure pocket 1315*b* may be partially sealed, and accordingly, an oil storage capacity in the second main back pressure pocket 1315*b* may be improved. Accordingly, a pressure of oil supplied to the rear end surface of the vane 1351, 1352, 1353 may be made uniform, thereby suppressing or preventing pressure pulsation at the rear end surface of the vane 1351, 1352, 1353. With this structure, a back pressure formed on the rear end surface of the vane 1351, 1352, 1353 may be constant, making it possible to suppress wobbling of the vane 1351, 1352, 1353 more effectively.

Referring to FIGS. 10 and 12, the vane support protrusion may also be formed in the same way on the sub bearing 132, as in the previous embodiment. In other words, the vane support protrusion (hereinafter, referred to as the sub vane support protrusion) 1327 may protrude axially from the inner circumferential surface of the second sub back pressure pocket 1325*b* and extend along the circumferential direction, and a sub oil passage groove 1329 may be formed at one side of the sub vane support protrusion 1327. In this case as well, the sub vane support protrusion 1327 and the sub oil passage groove 1329 may be formed symmetrically to the main vane support protrusion 1317 and the main oil passage groove 1329, respectively. Therefore, the sub vane support protrusion 1327 and the sub oil passage groove 1329 will be understood by the description of the main vane support protrusion 1317 and the main oil passage groove 1329.

Additionally, the previously described vane support protrusion may be formed only on the sub bearing 132, as in the previous embodiment. In other words, the main vane support protrusion (not illustrated) described above may be excluded and only the sub vane support protrusion 1327 may be formed. In this case as well, the sub vane support protrusion 1327 and the sub oil passage groove 1329 may be formed symmetrically to the main vane support protrusion 1317 and the main oil passage groove 1329, respectively. Therefore, the sub vane support protrusion 1327 and the sub oil passage groove 1329 will be understood by the description of the main vane support protrusion 1317 and the main oil passage groove 1329.

Hereinafter, description will be given of a vane support protrusion according to still another embodiment. That is, in the previous embodiments, the vane support protrusion extends from the inner circumferential surface of the back pressure pocket along the reciprocating direction of the vane or protrudes in the axial direction from the back pressure pocket. However, in some cases, the vane support protrusion may be formed to protrude axially from the back pressure pocket while extending from the inner circumferential surface of the back pressure pocket along the reciprocating direction of the vane.

Figure 15:
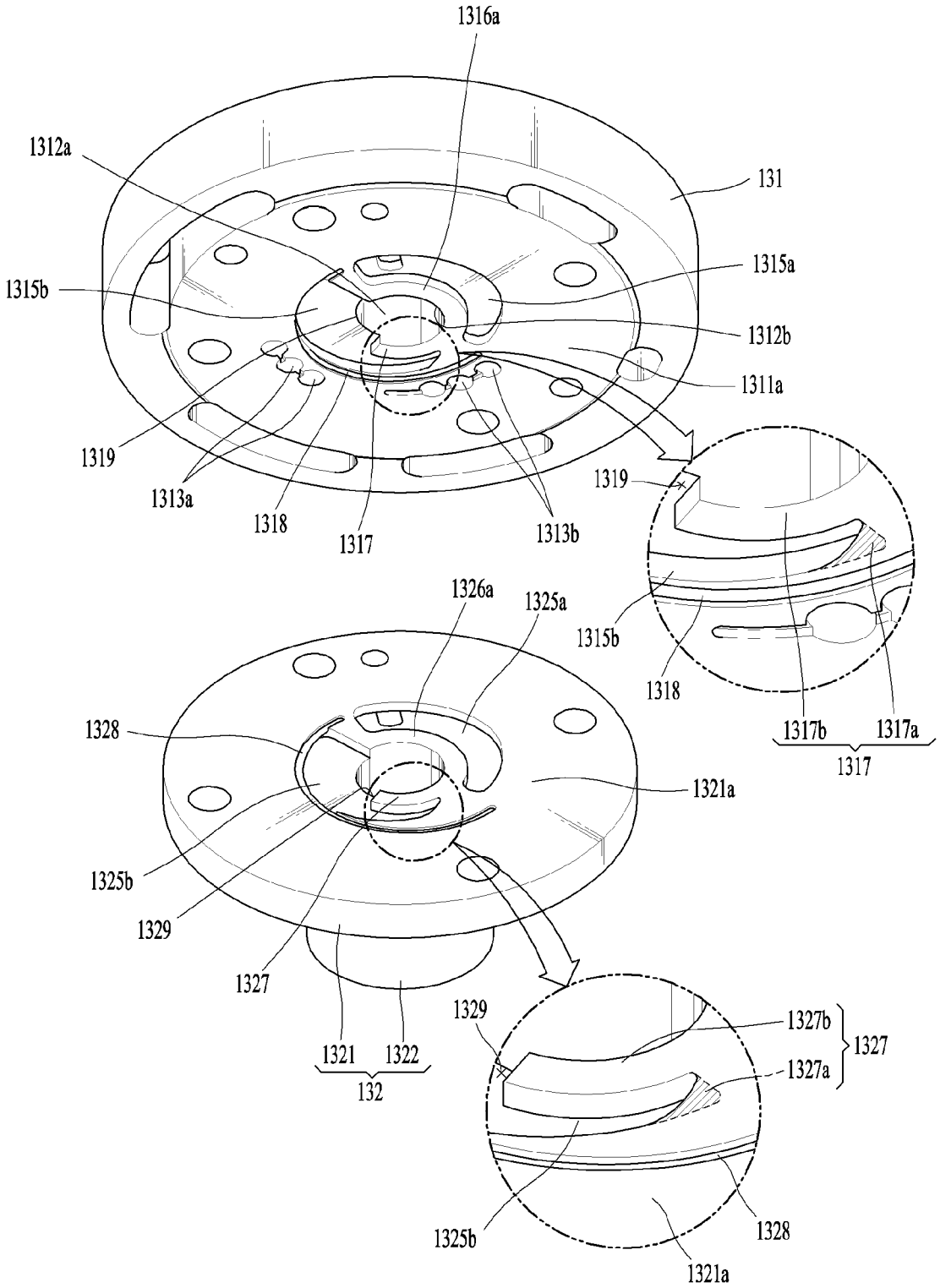
FIG. 15 is a perspective view of a main bearing and a sub bearing each having a vane support protrusion according to still another embodiment.
Figure 16:
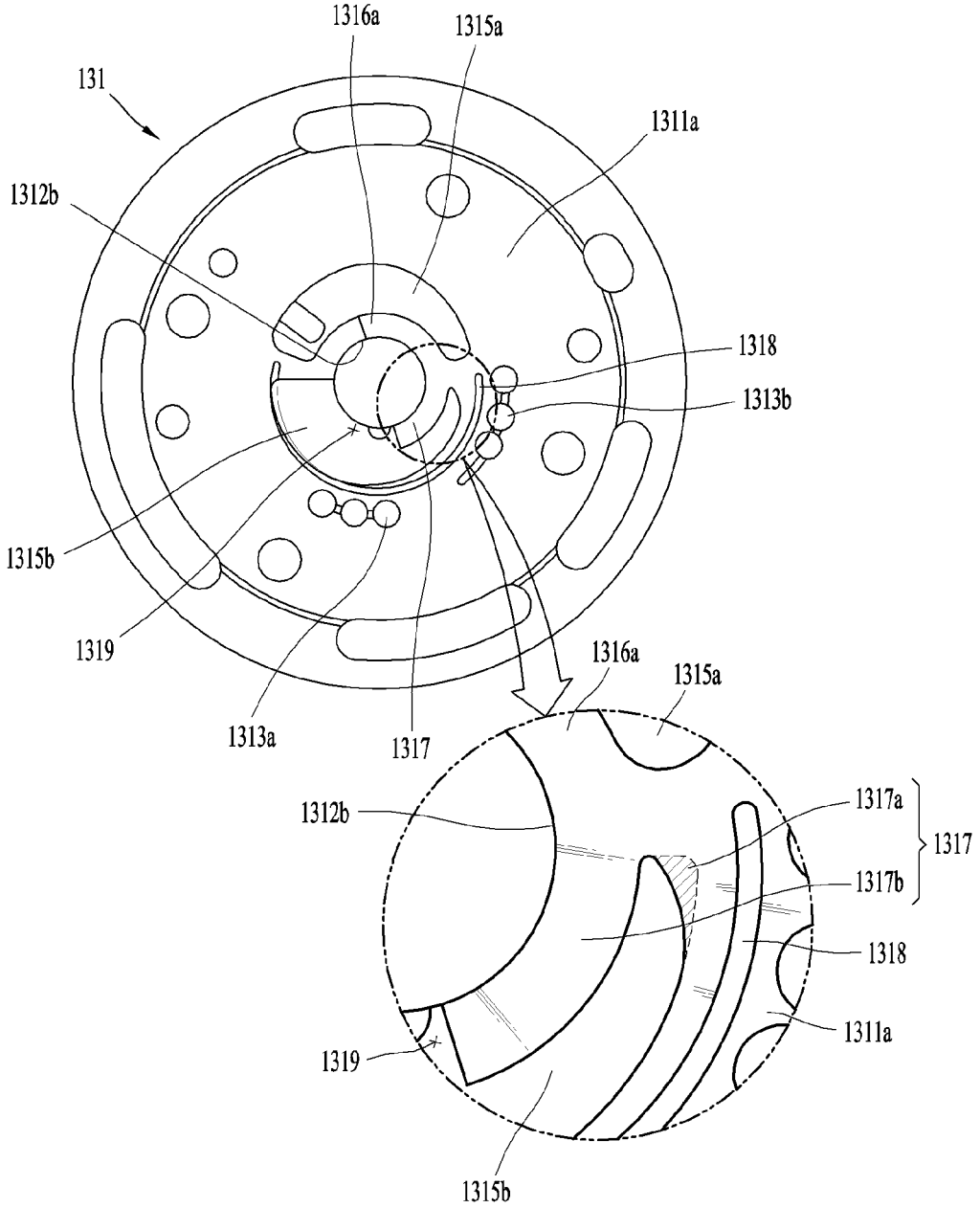
FIG. 16 is a planar view of the main bearing in FIG. 15.
Figure 17:
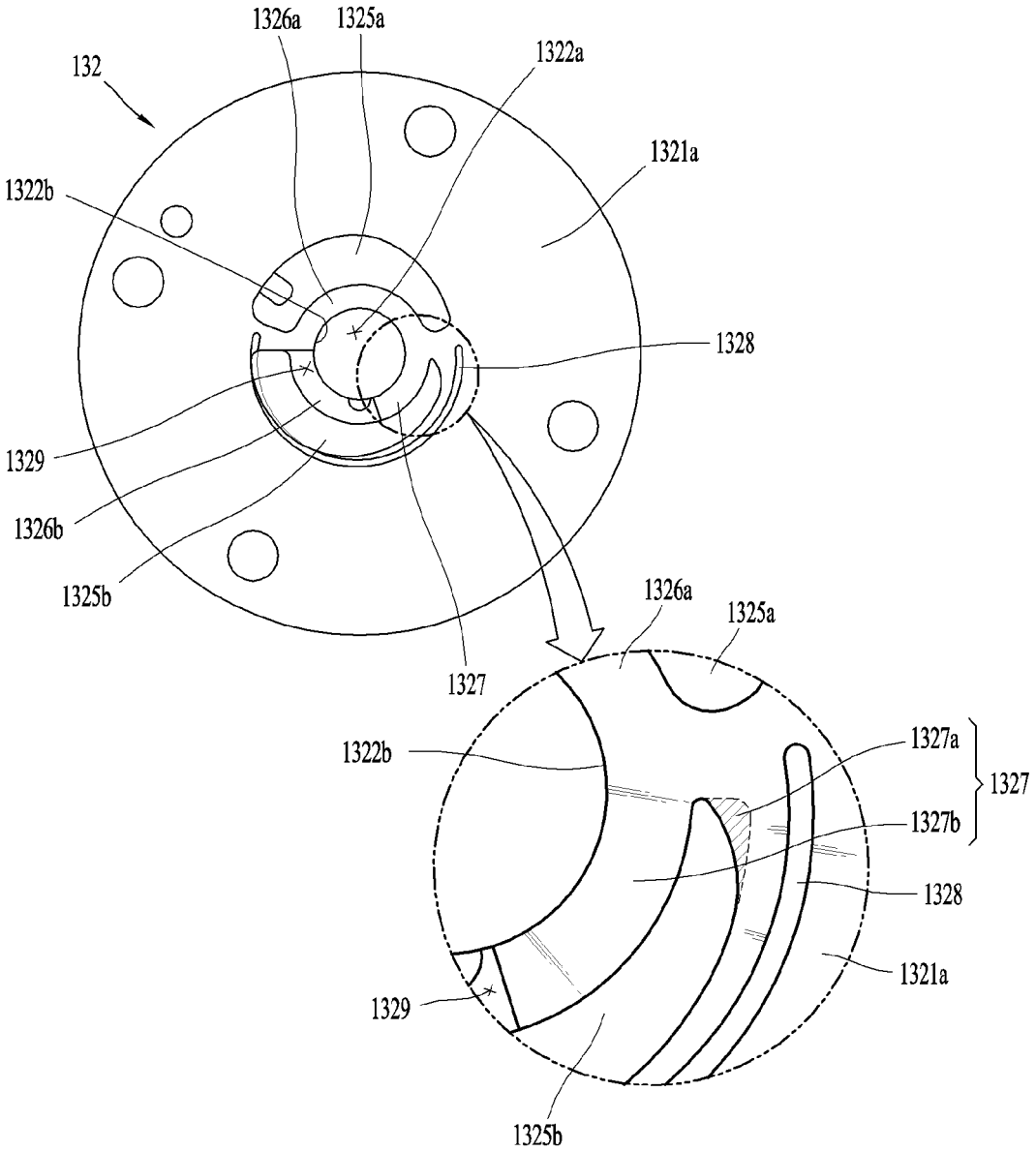
FIG. 17 is a planar view of the sub bearing in FIG. 15.
Figure 18:
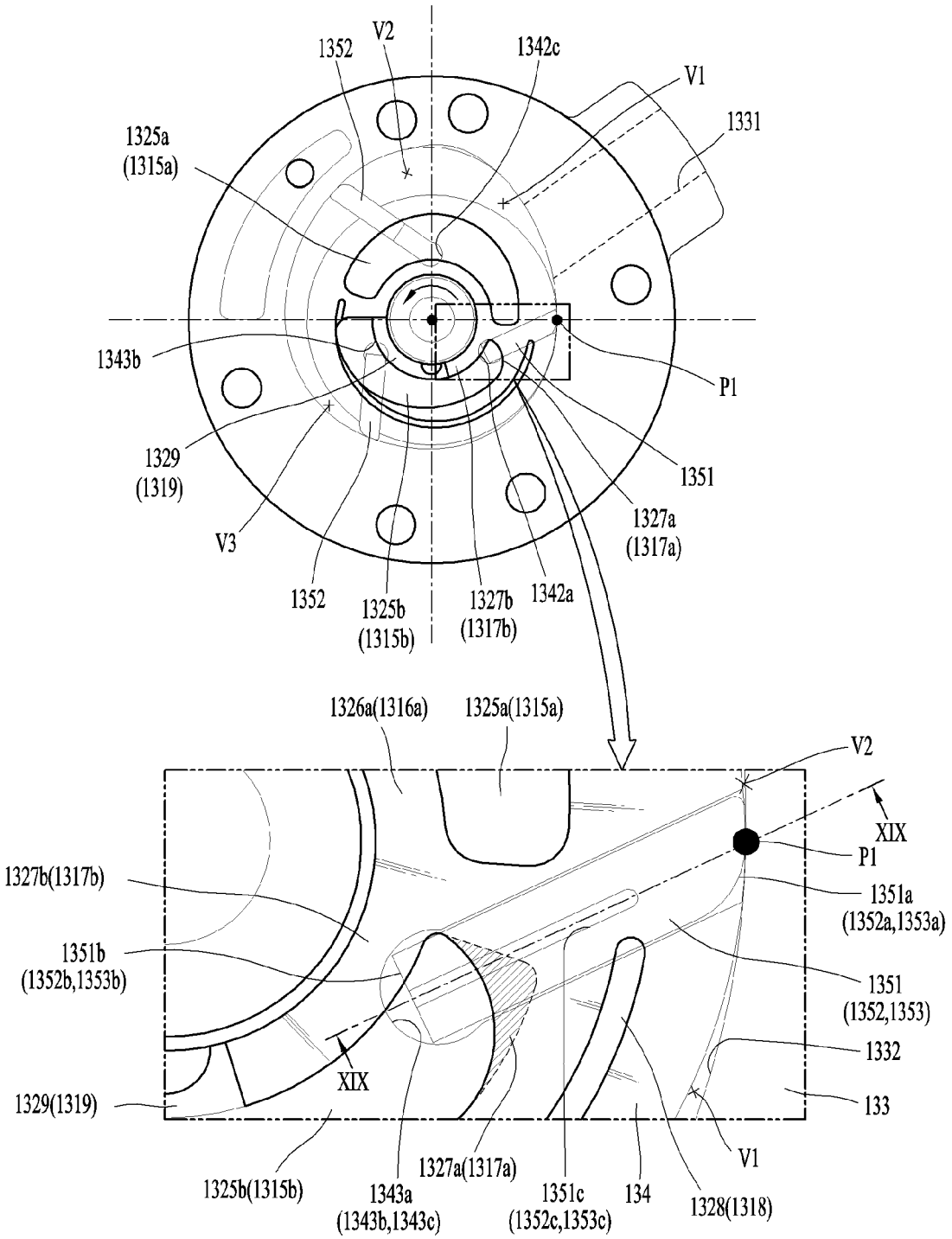
FIG. 18 is a schematic view for explaining an effect of the vane support protrusion in FIG. 15.
Figure 19:
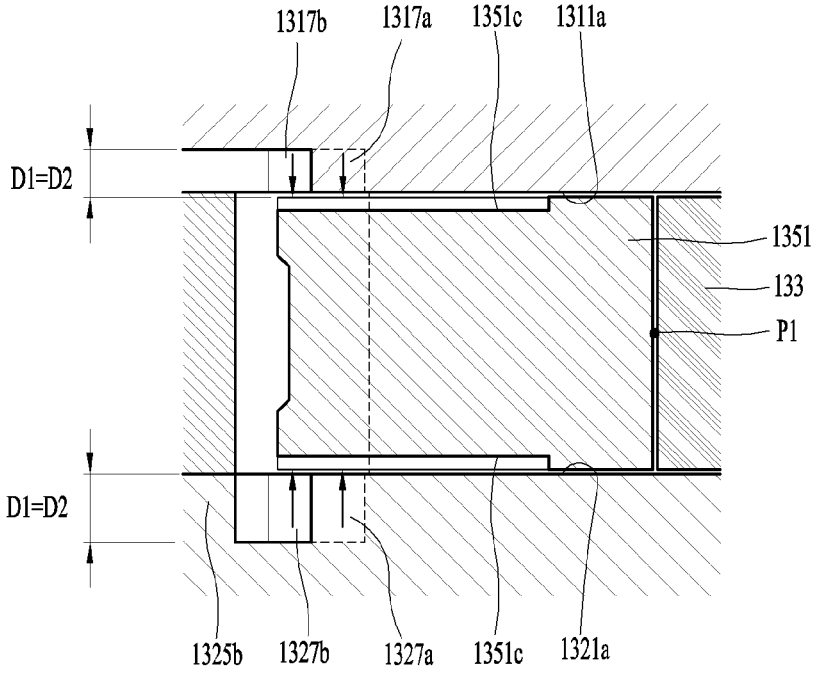
FIG. 19 is a cross-sectional view, taken along line "XIX-XIX" of FIG. 18.

FIG. 15 is a perspective view illustrating a main bearing and a sub bearing each having a vane support protrusion according to still another embodiment. FIG. 16 is a planar view illustrating the main bearing in FIG. 15. FIG. 17 is a planar view illustrating the sub bearing in FIG. 15. FIG. 18 is a schematic view for explaining an effect of the vane support protrusion in FIG. 15, and FIG. 19 is a cross-sectional view, taken along line "XIX-XIX" of FIG. 18.

Referring to FIGS. 15 to 19, as the basic configuration and operating effects of the rotary compressor according to this embodiment are almost the same as those of the previous embodiments, detailed description thereof will be replaced by the description of the previous embodiments. For example, at least one vane slot 1341*a*, 1341*b*, 1341*c* may be formed in the roller 134 eccentrically inserted into the cylinder 133, and the vane 1351, 1352, 1353 may be slid into the vane slot 1341*a*, 1341*b*, 1341*c*. The vane 1351, 1352, 1353 may be axially supported by the main bearing 131 and the sub bearing 132, which are coupled to the both axial sides of the cylinder 133. The back pressure pockets [1315*a* and 1315*b*], [1325*a* and 1325*b*] communicating with the oil passage 125 of the rotational shaft 123 may be formed in at least one of the main bearing 131 or the sub bearing 132. The back pressure pockets [1315*a* and 1315*b*], [1325*a* and 1325*b*] may communicate with the back pressure chamber 1342*a*, 1342*b*, 1342*c* disposed inside the vane slot 1341*a*, 1341*b*, 1341*c*. Accordingly, high-pressure oil may be introduced into the back pressure chamber 1342*a*, 1342*b*, 1342*c* through the oil passage 125 of the rotational shaft 123 and the back pressure pockets [1315*a* and 1315*b*], [1325*a* and 1325*b*] to press the vane 1351, 1352, 1353 toward the cylinder 133, thereby suppressing or preventing wobbling of the vane 1351, 1352, 1353.

However, in this case, as described above, the back pressure pockets [1315*a* and 1315*b*] and [1325*a* and 1325*b*] are formed to be recessed by preset or predetermined depths into the main axial bearing surface 1311*a* of the main bearing 131 and/or the sub axial bearing surface 1321*a* of the sub bearing 132 that support the vane 1351, 1352, 1353 in the axial direction. This reduces the axial support area for the vane 1351, 1352, 1353. As a result, a support force for the rear end of the vane 1351, 1352, 1353 may decrease and axial tilting may occur. In particular, in the case of the vane 1351, 1352, 1353 passing near the contact point P1, the vane 1351, 1352, 1353 may be subject to a strong gas repulsive force applied from the compression chamber to thereby be moved backward and/or more tilted in the axial direction.

Accordingly, in this embodiment, the vane support protrusion 1317, 1327 extending from the main axial bearing surface 1311*a* and/or the sub axial bearing surface 1321*a* may be formed, as in the previous embodiments. However, in the embodiment, the vane support protrusions 1317, 1327 may respectively be formed inside and outside of the back pressure pocket [1315*a*, 1315*b*], [1325*a*, 1325*b*], to secure a much wider axial support area for the vane 1351, 1352, 1353 without excessively reducing the volume of the back pressure pocket [1315*a*, 1315*b*], [1325*a*, 1325*b*]. The vane support protrusions 1317, 1327 may be formed on at least one of the main bearing 131 or the sub bearing 132, but in this embodiment, an example in which the vane support protrusions are formed on the main bearing 131 will be mainly described.

Referring to FIGS. 15 and 16, the main plate portion 1311 of the main bearing 131 according to this embodiment may include, as described above, the first main back pressure pocket 1315*a* and the second main back pressure pocket 1315*b* formed along the circumferential direction to be spaced apart from each other by a preset or predetermined gap. The first main bearing protrusion 1316*a* may be formed on the inner circumferential side of the first main back pressure pocket 1315*a*, and the second main vane support protrusion 1317 described hereinafter, which defines the second main bearing protrusion (no reference numeral) formed as a partial partition wall, may be formed on the inner circumferential side of the second main back pressure pocket 1315*b*. Accordingly, oil of a low intermediate pressure may be filled inside of the first main back pressure pocket 1315*a* while oil of a high intermediate pressure (or a discharge pressure) may be filled inside of the second main back pressure pocket 1315*b*.

More specifically, a first main bearing protrusion 1317*a* may be formed inside of the second main back pressure pocket 1315*b*, and a second sub bearing protrusion 1317*b* may be formed outside of the second main back pressure pocket 1315*b*. For example, the first main vane support protrusion 1317*a* may extend in the circumferential direction (lateral direction) from the second main back pressure pocket 1315*b* to be flush with the main axial bearing surface 1311*a*, and the second main vane support protrusion 1317*b* may protrude in the axial direction from a partial section of the inner circumferential surface of the second main back pressure pocket 1315*b* to be flush with the main axial bearing surface 1311*a*. Accordingly, as illustrated in FIGS. 18 and 19, the rear axial side surface of the vane 1351, 1352, 1353 may be supported in the axial direction by the first main vane support protrusion 1317*a* and the second main vane support protrusion 1317*b*, thereby greatly increasing the axial support area for the vane 1351, 1352, 1353. This may effectively suppress or prevent axial tilting of the vane 1351, 1352, 1353 that passes near the contact point P1.

For example, the first main vane support protrusion 1317*a* may be formed in an area, close to the contact point P1, in which the outer wall surface 1315*d* and the second side wall surface 1315*f* meet, on the inner circumferential surface of the second main back pressure pocket 1315*b*. The first main vane support protrusion 1317*a* may protrude in the axial direction from the bottom surface of the second main back pressure pocket 1315*b* and simultaneously extend in the reciprocating direction of the vane 1351, 1352, 1353 from the main axial bearing surface 1311*a* toward the inner wall surface 1315*c* of the second main back pressure pocket 1315*b*, namely, the second main vane support protrusion 1317*b*. As the first vane support protrusion 1317*a* is the same as the main vane support protrusion 1317 illustrated in the embodiment of FIG. 4, it may be understood from the description of the embodiment of FIG. 4.

The second main vane support protrusion 1317*b* may protrude in the axial direction from the main axial bearing surface 1311*a* at one or a first end, close to the contact point P1, of circumferential ends at the inner circumferential side of the second main back pressure pocket 1315*b* and extend toward another or a second end of the opposite side in the circumferential direction, and the main oil passage groove 1319 may be formed in one side of the second main vane support protrusion 1317*b* in the circumferential direction. As the second main vane support protrusion 1317*b* and the main oil passage groove 1319 are the same as the main vane support protrusion 1317 and the main oil passage groove 1319 illustrated in the embodiment of FIG. 10, they may be understood from the description of the embodiment of FIG. 10.

Referring to FIGS. 15 and 17, the vane support protrusion may be formed in the same way on the sub bearing 132. In other words, the first vane support protrusion (hereinafter, referred to as a first sub vane support protrusion) 1327*a* may extend from the inner circumferential surface of the second sub back pressure pocket 1325*b* in the reciprocating direction of the vane 1351, 1352, 1353, and the second vane support protrusion (hereinafter, referred to as a second sub vane support protrusion) 1327*b* may protrude in the axial direction from the inner circumferential side of the second sub back pressure pocket 1325*b* and extend along the circumferential direction. In this case as well, a sub oil passage groove 1329 may be formed by being open in one side of the second sub vane support protrusion 1327*b* in the circumferential direction. The first sub vane support protrusion 1327*a* may be formed symmetrically to the first main vane support protrusion 1317*a*, and the second sub vane support protrusion 1327*b* may be formed symmetrically to the second main vane support protrusions 1317*b*. Accordingly, the first sub vane support protrusion 1327*a* and the second sub vane support protrusion 1327*b* may be understood from the descriptions of the first main vane support protrusion 1317*a* and the second main vane support protrusion 1317*b*. This also applies to the main oil passage groove 1319 and the sub oil passage groove 1329.

Additionally, the first and second vane support protrusions 1327*a* and 1327*b* described above may be formed only on the sub bearing 132. In this case as well, the first sub vane support protrusion 1327*a* and the second sub vane support protrusion 1327*b* may be formed the same as the first main vane support protrusion 1317*a* and the second main vane support protrusion 1317*b*. Accordingly, the first sub vane support protrusion 1327*a* and the second sub vane support protrusion 1327*b* may be understood from the descriptions of the first main vane support protrusion 1317*a* and the second main vane support protrusion 1317*b*. This also applies to the main oil passage groove 1319 and the sub oil passage groove 1329.

Embodiments disclosed herein provide a rotary compressor capable of reducing friction loss, wear, and vibration noise due to axial tilting of a vane during an operation of the compressor.

Embodiments disclosed herein also provide a rotary compressor capable of increasing a support area for an axial side surface of a vane, which passes near a contact point during an operation of the compressor.

Further, embodiments disclosed herein provide a rotary compressor capable of suppressing or preventing friction loss or wear and vibration noise between an axial side surface of a vane, which passes near a contact point during an operation of the compressor, and an axial bearing surface facing the same while increasing a support area for the axial side surface of the vane.

Furthermore, embodiments disclosed herein provide a rotary compressor capable of quickly securing back pressure while enhancing axial support force applied to a vane, which passes near a contact point during an operation of the compressor.

Additionally, embodiments disclosed herein provide a rotary compressor capable of securing radial support force for a rotational shaft while quickly increasing back pressure for a vane during an operation of the compressor.

Embodiments disclosed herein provide a rotary compressor capable of suppressing a vane from tilting in an axial direction even when a high-pressure refrigerant such as R32, R410a, or $CO_2$ is used.

To achieve those aspects and other advantages of the subject matter disclosed herein, a rotary compressor is provided that may include a casing, a cylinder, a main bearing, a sub bearing, a rotational shaft, a roller, and at least one vane. The casing may define an oil storage space therein, the cylinder may be fixed inside of the casing to form a compression space, the main bearing and sub bearing may be disposed on both sides of the cylinder in an axial direction, the rotational shaft may be supported on the main bearing and the sub bearing and define an oil passage therein, the roller may be disposed on the rotational shaft and form at least one contact point where an outer circumferential surface thereof is in contact with an inner circumferential surface of the cylinder, and the at least one vane may be slidably inserted into the roller to divide the compression space into a plurality of compression chambers. A back pressure pocket having a preset or predetermined depth may be formed in a bearing surface, facing the roller, of at least one of the main bearing or the sub bearing. A vane support portion may be formed on the bearing surface to support the vane in the axial direction. The vane support portion may include a vane support protrusion that extends along a reciprocating direction of the vane from an inner circumferential surface of the back pressure pocket at an end, adjacent to the contact point, of both ends of the back pressure pocket in a circumferential direction or extend along the inner circumferential surface of the back pressure pocket in the circumferential direction. With this structure, a wide axial support area for a rear end of the vane passing the contact point and/or near the contact point may be secured to suppress or prevent axial tilting of the vane, thereby reducing friction loss or wear and vibration noise due to the axial tilting of the vane during operation of the compressor.

The vane support protrusion may be formed such that at least a portion thereof is located in a discharge section of the compression chamber. This may secure a wide axial support area for a rear end of the vane that passes the contact point and/or near the contact point.

A circumferential length of the vane support protrusion may be shorter than a length of the discharge section. This may suppress or prevent an unnecessary expansion of an axial support area for the rear end of the vane, which is located far away from the contact point and/or a portion near the contact point, thereby reducing friction loss and wear.

The vane support protrusion may extend from the bearing surface adjacent to the contact point. A height of the vane support protrusion may be lower than or equal to a height of the bearing surface. This may expand a substantial axial support area for the rear end of the vane and smoothly lubricate between the rear end of the vane and an axial bearing surface facing the rear end.

The vane support protrusion may be formed to be flush with the bearing surface. This may expand a substantial axial support area for the rear end of the vane.

An oil supply groove that communicates with the back pressure pocket and extending toward a radial outside of the back pressure pocket may be formed in at least one of the main bearing or the sub bearing. The oil supply groove may at least partially overlap the vane support protrusion in a radial direction. This may expand a substantial axial support area for the rear end of the vane and simultaneously smoothly lubricate between the rear end of the vane and the bearing surface facing the rear end.

An oil supply guide groove may extend along a longitudinal direction of the vane from an axial side surface of the vane in contact with the bearing surface. The oil supply guide groove may communicate with the back pressure pocket without at least partially overlapping the vane support protrusion. This may expand a substantial axial support area for the rear end of the vane and simultaneously smoothly provide lubrication between the rear end of the vane and the bearing surface facing the rear end.

The back pressure pocket may include an inner wall surface, an outer wall surface, and a first side wall surface and a second side wall surface that connect both ends of the inner wall surface and the outer wall surface. The vane support protrusion may be formed as the second side wall surface and the outer wall surface adjacent to the contact point extend toward the inner wall surface. With this structure, the vane support protrusion may be formed continuously from the bearing surface, which may not only stabilize the behavior of the vane, but also secure a wide inlet area of the back pressure pocket, thereby quickly increasing back pressure on the vane and maintaining it stably.

An inner circumferential surface of the vane support protrusion may be formed in an area where the second side wall surface and the outer wall surface meet. A gap between the inner circumferential surface of the vane support protrusion and the inner wall surface may be gradually decreased in a direction toward the contact point. With this structure, the vane support protrusion may be formed to correspond to a movement path of the vane and stably support the rear end of the vane.

More specifically, the outer wall surface may be formed in an arcuate shape with a first curvature, and the inner circumferential surface of the vane support protrusion may be formed in an arcuate shape with a second curvature. The second curvature may be greater than the first curvature. With this structure, the vane support protrusion may be formed to correspond to the movement path of the vane and stably support the rear end of the vane.

The outer wall surface may be formed in an arcuate shape with a first curvature, and the second side wall surface defining the inner circumferential surface of the vane support protrusion may be formed in an arcuate shape with a second curvature. An arcuate length of the vane support protrusion may be smaller than or equal to an arcuate length of the outer wall surface. This may suppress or prevent an unnecessary contact between the vane and the axial bearing surface in an area far from the contact point, thereby reducing friction loss and wear.

A shortest distance from the contact point to the vane support protrusion may be 0.7 to 0.9 times a length of the vane. This may secure a substantial axial support area for the rear end of the vane at the contact point and/or near the contact point.

The back pressure pocket may include an inner wall surface, an outer wall surface, and a first side wall surface and a second side wall surface connecting both ends of the inner wall surface and the outer wall surface. The vane support protrusion may protrude in the axial direction and extend along the inner circumferential surface of the back pressure pocket. With this structure, the vane support protrusion may be located far away in the reciprocating direction of the vane, thereby maintaining a volume of the back pressure pocket while securing a substantial axial support area for the rear end of the vane at the contact point and/or near the contact point.

For example, an oil passage groove that is open toward the outer circumferential surface of the rotational shaft in the back pressure pocket may be formed at one side of the vane support protrusion in the circumferential direction. An arcuate length of the vane support protrusion may be shorter than or equal to an arcuate length of the oil passage groove. With this structure, the vane support protrusion may be formed continuously from the axial bearing surface, which may not only stabilize the behavior of the vane, but also secure a wide inlet area of the back pressure pocket, thereby quickly increasing back pressure on the vane and simultaneously maintaining the back pressure stably.

More specifically, a depth of the oil passage groove may be formed to be equal to a depth of the back pressure pocket with the oil passage groove. This may secure the inlet area of the back pressure pocket as wide as possible, thereby quickly increasing back pressure on the vane and simultaneously maintaining the back pressure stably.

Additionally, the vane support protrusion may be formed to support an end, adjacent to the rotational shaft, of both ends of the vane in the reciprocating direction. This may secure a substantial axial support area for the rear end of the vane at the contact point and/or near the contact point and also maintain the volume of the back pressure pocket.

The back pressure pocket may include an inner wall surface, an outer wall surface, and a first side wall surface and a second side wall surface that connect both ends of the inner wall surface and the outer wall surface. The vane support protrusion may include a first vane support protrusion that extends along a reciprocating direction of the vane from one end of the back pressure pocket adjacent to the contact point, and a second vane support protrusion protruding in the axial direction from an inner circumferential surface of the back pressure pocket. With this structure, a cross-sectional area of the vane support protrusion may be formed as wide as possible while minimizing a reduction in volume of the back pressure pocket, so as to stably support the rear end of the vane in the axial direction, thereby reducing friction loss or wear and vibration noise due to axial tilting of the vane during operation of the compressor.

The first vane support protrusion may be formed as the second side wall surface and the outer wall surface adjacent to the contact point extend toward the inner wall surface. With this structure, the vane support protrusion may be formed continuously from the bearing surface, which may not only stabilize the behavior of the vane, but also secure the wide inlet area of the back pressure pocket, thereby quickly increasing back pressure on the vane and simultaneously maintaining the back pressure stably.

More specifically, an inner circumferential surface of the first vane support protrusion may be formed in an area where the second side wall surface and the outer wall surface meet. A gap between an inner circumferential surface of the first vane support protrusion and the inner wall surface may be gradually decreased in a direction toward the contact point. With this structure, the vane support protrusion may be formed to correspond to a movement path of the vane and stably support the rear end of the vane.

More specifically, the outer wall surface may be formed in an arcuate shape with a first curvature, and the inner circumferential surface of the first vane support protrusion may be formed in an arcuate shape with a second curvature. The second curvature may be greater than the first curvature. With this structure, the vane support protrusion may be formed to correspond to the movement path of the vane and stably support the rear end of the vane.

Additionally, the outer wall surface may be formed in an arcuate shape with a first curvature, and the inner circumferential surface of the first vane support protrusion may be formed in an arcuate shape with a second curvature. An arcuate length of the first vane support protrusion may be smaller than or equal to an arcuate length of the outer wall surface. With this structure, the vane support protrusion may be formed continuously from the axial bearing surface, which may not only stabilize the behavior of the vane, but also secure the wide inlet area of the back pressure pocket, thereby quickly increasing back pressure on the vane and simultaneously maintaining the back pressure stably.

A shortest distance from the contact point to the first vane support protrusion may be 0.7 to 0.9 times a length of the vane. This may secure a substantial axial support area for the rear end of the vane at the contact point and/or near the contact point.

An oil passage groove that is open toward the outer circumferential surface of the rotational shaft in the back pressure pocket may be formed at one side of the second vane support protrusion in the circumferential direction. An arcuate length of the second vane support protrusion may be shorter than or equal to an arcuate length of the oil passage groove. With this structure, the vane support protrusion may be formed continuously from the axial bearing surface, which may not only stabilize the behavior of the vane, but also secure the wide inlet area of the back pressure pocket, thereby quickly increasing back pressure on the vane and simultaneously maintaining the back pressure stably.

For example, a depth of the oil passage groove may be formed to be equal to a depth of the back pressure pocket. This may secure the inlet area of the back pressure pocket as wide as possible, thereby quickly increasing back pressure on the vane and simultaneously maintaining the back pressure stably.

The back pressure pocket may be provided as a plurality having different pressure and disposed to be spaced apart from each other in the circumferential direction with the bearing surface interposed therebetween. The vane support portion may be formed at a back pressure pocket having relatively high pressure among the plurality of back pressure pockets. With this structure, a wide axial support area for the rear end of the vane passing the contact point and/or near the contact point may be secured to suppress axial tilting of the vane, thereby reducing friction loss or wear and vibration noise due to axial tilting of the vane during operation of the compressor.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a casing;

a cylinder fixed inside of the casing to define a compression space;

a main bearing and a sub bearing respectively disposed on both sides of the cylinder in an axial direction;

a rotational shaft supported on the main bearing and the sub bearing;

a roller disposed on the rotational shaft, and forming at least one contact point at which an outer circumferential surface thereof is in contact with an inner circumferential surface of the cylinder; and at least one vane slidably inserted into the roller to divide the compression space into a plurality of compression chambers when the roller is rotated within the cylinder, wherein at least one back pressure pocket having a predetermined depth is formed in a bearing surface, facing the roller, of at least one of the main bearing or the sub bearing, wherein a vane support portion is formed on the bearing surface to support the at least one vane in the axial direction, wherein the vane support portion extends from an inner circumferential surface of the at least one back pressure pocket at a side adjacent to the contact point along a reciprocating direction of the at least one vane, wherein the at least one back pressure pocket includes an inner wall surface, an outer wall surface, and a first side wall surface and a second side wall surface that connect ends of the inner wall surface and the outer wall surface, wherein the vane support portion is formed as the second side wall surface and the outer wall surface adjacent to the contact point extends toward the inner wall surface, wherein an inner circumferential surface of the vane support portion is formed in an area where the second side wall surface and the outer wall surface meet, and wherein a gap between the inner circumferential surface of the vane support portion and the inner wall surface is gradually decreased in a direction toward the contact point.

2. The rotary compressor of claim 1, wherein the outer wall surface is formed in an arcuate shape with a first curvature, wherein the inner circumferential surface of the vane support portion is formed in an arcuate shape with a second curvature, and wherein the second curvature is greater than the first curvature.

3. The rotary compressor of claim 2, wherein an arcuate length of the vane support portion is smaller than or equal to an arcuate length of the outer wall surface.

4. The rotary compressor of claim 1, wherein a shortest distance from the contact point to the vane support portion is 0.7 to 0.9 times a length of the vane.

5. The rotary compressor of claim 1, wherein the at least one vane comprises a plurality of vanes, wherein the at least one back pressure pocket comprises a plurality of pressure pockets having different pressures and spaced apart from each other in a circumferential direction with the bearing surface interposed therebetween, and wherein the vane support portion is formed at a back pressure pocket having a relatively high pressure of the plurality of back pressure pockets.

6. The rotary compressor of claim 5, wherein the vane support portion is formed such that at least a portion thereof is located in a discharge section of the compression chamber, and wherein a circumferential length of the vane support portion is shorter than a length of the discharge section.

7. The rotary compressor of claim 5, wherein the vane support portion extends from the bearing surface adjacent to the contact point, wherein a height of the vane support portion is lower than or equal to a height of the bearing surface, and wherein the vane support portion is flush with the bearing surface.

8. The rotary compressor of claim 5, wherein an oil supply groove that communicates with the at least one back pressure pocket and extends toward a radial outside of the at least one back pressure pocket is formed in at least one of the main bearing or the sub bearing, and wherein the oil supply groove at least partially overlaps the vane support portion in a radial direction.

9. The rotary compressor of claim 5, wherein an oil supply guide groove extends along a longitudinal direction of the at least one vane from an axial side surface of the at least one vane in contact with the bearing surface, and wherein the oil supply guide groove communicates with the at least one back pressure pocket without at least partially overlapping the vane support portion.

* * * * *